US008529055B2

(12) United States Patent
Sugiyama

(10) Patent No.: US 8,529,055 B2
(45) Date of Patent: Sep. 10, 2013

(54) PRINTING APPARATUS

(75) Inventor: Shigeyuki Sugiyama, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 12/480,845

(22) Filed: Jun. 9, 2009

(65) Prior Publication Data

US 2009/0309942 A1 Dec. 17, 2009

(30) Foreign Application Priority Data

Jun. 13, 2008 (JP) ..... 2008-155246

(51) Int. Cl.
*B41J 2/01* (2006.01)

(52) U.S. Cl.
USPC ..... 347/104; 347/16

(58) Field of Classification Search
USPC ..... 304/16, 104; 347/16, 104
See application file for complete search history.

(56) References Cited

U.S. PATENT DOCUMENTS

| | | | | |
|---|---|---|---|---|
| 5,017,972 | A * | 5/1991 | Daughton et al. | 399/405 |
| 5,461,408 | A * | 10/1995 | Giles et al. | 347/102 |
| 5,738,457 | A * | 4/1998 | Ishida et al. | 400/706 |
| 6,102,506 | A | 8/2000 | Sasai et al. | 347/3 |
| 6,113,093 | A | 9/2000 | Morinaga et al. | 271/162 |
| 6,378,864 | B1 * | 4/2002 | Iesaka | 271/270 |
| 6,792,241 | B2 | 9/2004 | Nakagawa et al. | 399/367 |
| 7,101,096 | B2 | 9/2006 | Sasai et al. | 400/48 |
| 7,165,902 | B2 * | 1/2007 | Ejiri et al. | 400/625 |
| 7,540,603 | B2 * | 6/2009 | Otsuki | 347/105 |
| 7,695,129 | B2 * | 4/2010 | Yoshikawa et al. | 347/104 |
| 2004/0017459 | A1 * | 1/2004 | Kawaguchi et al. | 347/104 |
| 2005/0047840 | A1 * | 3/2005 | Ohashi | 399/388 |
| 2005/0258586 | A1 * | 11/2005 | Elenes et al. | 271/9.01 |
| 2006/0083566 | A1 * | 4/2006 | Hwang | 399/391 |
| 2006/0204310 | A1 * | 9/2006 | Inokuchi et al. | 400/680 |
| 2007/0025794 | A1 * | 2/2007 | Kubin et al. | 400/605 |
| 2007/0059052 | A1 | 3/2007 | Tanaami | 399/299 |

FOREIGN PATENT DOCUMENTS

| | | |
|---|---|---|
| JP | 2002-192782 | 7/2002 |
| JP | 2005-246851 A | 9/2005 |
| JP | 2006-264930 A | 10/2006 |
| JP | 2007-70105 | 3/2007 |

OTHER PUBLICATIONS

Japanese Office Action dated Nov. 27, 2012, issued by the Japanese Patent Office, in counterpart Japanese Patent Application No. 2008-155246.

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A printing apparatus has a conveyance path configured to convey a printing medium toward a print position, a feeder for feeding the print media into the conveyance path and a control unit for controlling the printing apparatus selectively in a first mode and a second mode. In a first mode, the control unit controls the printing apparatus such that a printing medium fed from the feeder is firstly conveyed up to a position where a rear end of the printing medium gets out of the feeder, after the first conveyance, the printing medium is conveyed reversely in the conveyance path, and after that, after the reverse conveyance, the printing medium is conveyed to the print position and then the printing medium is printed by the printing unit. In the second mode, the control unit controls the printing apparatus such that the printing medium fed from the feeder is printed by the printing unit without being conveyed reversely.

10 Claims, 21 Drawing Sheets

| FIG.16A | |
|---|---|
| FIG.16B | |

PRINTING APPARATUS

BACKGROUND OF THE INVENTION

1. Field of the Invention

The present invention relates to a printing apparatus, and particularly relates to a printing apparatus capable of selecting a suitable conveyance path from multiple conveyance paths according to a type of printing medium and/or a selected print quality.

2. Description of the Related Art

A printing apparatus such as an inkjet printing apparatus forms an image on a printing medium by moving the printing medium and a printing head, which is used to apply a printing agent, relative to each other. If printing media are relatively soft like plain paper, many printing media can be stacked on an inclined sheet feeding tray, and are separately fed one by one by a sheet feeding roller. Then, the printing medium is fed while changing its feeding path by gently bending along the sheet feeding roller, and then is printed and discharged. Instead, such printing media are housed in a cassette disposed at a lower portion of the apparatus, and are fed one by one by a sheet feeding roller. The printing medium thus fed is bent and conveyed in the reverse direction by the sheet feeding roller, turn-over rollers or other similar rollers. After that, the printing medium is printed and further conveyed.

In contrast, printing is performed on a printing medium, such as a thick printing medium, a printing medium desired not to bend, and also a printing medium, like a CD-R, practically incapable of bending (in essence, a printing medium having a relatively high stiffness), while the printing medium is conveyed entirely in one plane. To this end, a printing apparatus having a conveyance path in one plane in addition to a conveyance path as described above has been proposed and been put into practical use (For example, see Japanese Patents Laid-open Nos. 2002-192782 and 2007-70105). In this description, such a conveyance path in one plane and printing accompanied by a conveyance operation through the conveyance path are referred to as a flat path and flat path printing, respectively.

Japanese Patent Laid-open No. 2002-192782 discloses a configuration including a pair of conveying rollers for conveying a printing medium by nipping the printing medium therebetween from its both sides when printing is performed. With this configuration, a user himself/herself separates and presses together the pair of conveying rollers to set a printing medium. More specifically, in order to perform the flat path printing on a printing medium such as thick paper, the user sets the printing medium by once separating the pair of conveying rollers from each other; horizontally inserting the printing medium into a manual feeding port provided on the back of an apparatus; and then pressing the pair of conveying rollers against each other with the printing medium nipped therebetween. In short, a printing medium is horizontally fed by a user in the sheet feeding operation, whereby the flat path is put into practice without causing the printing medium to bend in the sheet feeding operation.

On the other hand, Japanese Patent Laid-open No. 2007-70105 discloses another configuration including a pair of conveying rollers for conveying a printing medium by nipping the medium therebetween from its both sides. In this configuration, the pair of conveying rollers are automatically separated from and pressed against each other. Moreover, an apparatus with this configuration employs a structure allowing a printing medium to be horizontally inserted into the apparatus from the front of the apparatus. Thus, this configuration has an advantage that the operation needed to be performed by a user is easy.

The foregoing methods described in Japanese Patents Laid-open Nos. 2002-192782 and 2007-70105, however, have several problems. For example, the configuration in which a user manually separates and presses together the conveying rollers as in Japanese Patent Laid-open No. 2002-192782 requires the user's manual operation, which may result in an operational error. Moreover, since a printing medium is inserted from the back of the apparatus, this configuration has a problem of poor operability in setting the printing medium. On the other hand, the configuration described in Japanese Patent Laid-open No. 2007-70105 has good operability because the apparatus has the conveying rollers automatically separated and pressed together and allows a printing medium to be inserted from the front of the apparatus. In some cases, however, the flat path printing is desired on a thin printing medium such as plain paper and photo paper, that is, a relatively soft printing medium, as well as a printing medium having relatively high stiffness as described above. When using such a relatively soft printing medium, a user has difficulty in setting the printing medium with high accuracy even with the configuration allowing the printing medium to be set from the front of the apparatus.

SUMMARY OF THE INVENTION

The present invention has been made in consideration of the foregoing problems, and aims to allow even a relatively soft printing medium to be easily set in a printing apparatus when performing flat path printing.

In an aspect of the present invention, there is provided a printing apparatus including a feeder on which a plurality of printing media are stackable, which is capable of feeding the printing media separately one by one, and which includes a feeding path that curves with respect to a conveyance surface where each of the printing media is printed on a print position by a printing unit, the printing apparatus comprising: a conveyance path that is a flat conveyance path continuous with the conveyance surface and is configured to convey the printing medium toward the print position; and a control unit that, without causing the printing unit to perform printing, causes the printing medium to be firstly conveyed from the feeder up to a position where a rear end of the printing medium gets out of the feeding path, and that, after the first conveyance, causes the printing medium to be conveyed reversely in the conveyance path, and that, after the reverse conveyance, causes the printing medium to be conveyed to the print position and then to be printed by the printing unit.

In another aspect of the present invention, there is provided a printing apparatus comprising: a flat conveyance path on which a disk-shaped printing medium is conveyable; a printing unit that performs printing on a printing medium conveyed on the conveyance path; a feeder that separates stacked printing media from one to another, and feeds each separated printing medium to the conveyance path through a curving feeding path continuous with the conveyance path; a first mode in which a printing medium fed from the feeder is conveyed until a rear end of the printing medium gets out of the feeding path and then is reversely conveyed, and then in which printing is started under a condition where the printing medium is entirely inside the conveyance path; a second mode in which printing is started under a condition where a part of a printing medium fed from the feeder still remains on the feeding path; and a selector that selects one of the first mode and the second mode.

According to the present invention, the flat path printing can be performed even when printing media are set on the feeder that is disposed in the printing apparatus and is configured to feed the printing media separately one by one. Accordingly, even when the flat path printing is to be performed on a relatively soft printing medium, the printing medium can be set easily and surely on the printing apparatus. Consequently, printing quality can be enhanced.

Further features of the present invention will become apparent from the following description of exemplary embodiments (with reference to the attached drawings).

BRIEF DESCRIPTION OF THE DRAWINGS

FIG. 14A is a perspective view of the mechanism from the back side when the upper case is detached from the printing apparatus main body; and FIG. 14B is a perspective view of the mechanism when the sheet feeding section is further detached from the printing apparatus main body in FIG. 14A;

FIG. 15A is a view showing that the sheet guide flapper is lifted, and FIG. 15B is a view showing that the sheet guide flapper is lowered;

FIG. 18A shows the conveyance path continued from the sheet feeding section; and FIG. 18B shows the conveyance path switched to the flat path;

DESCRIPTION OF THE EMBODIMENTS

Figure 1:
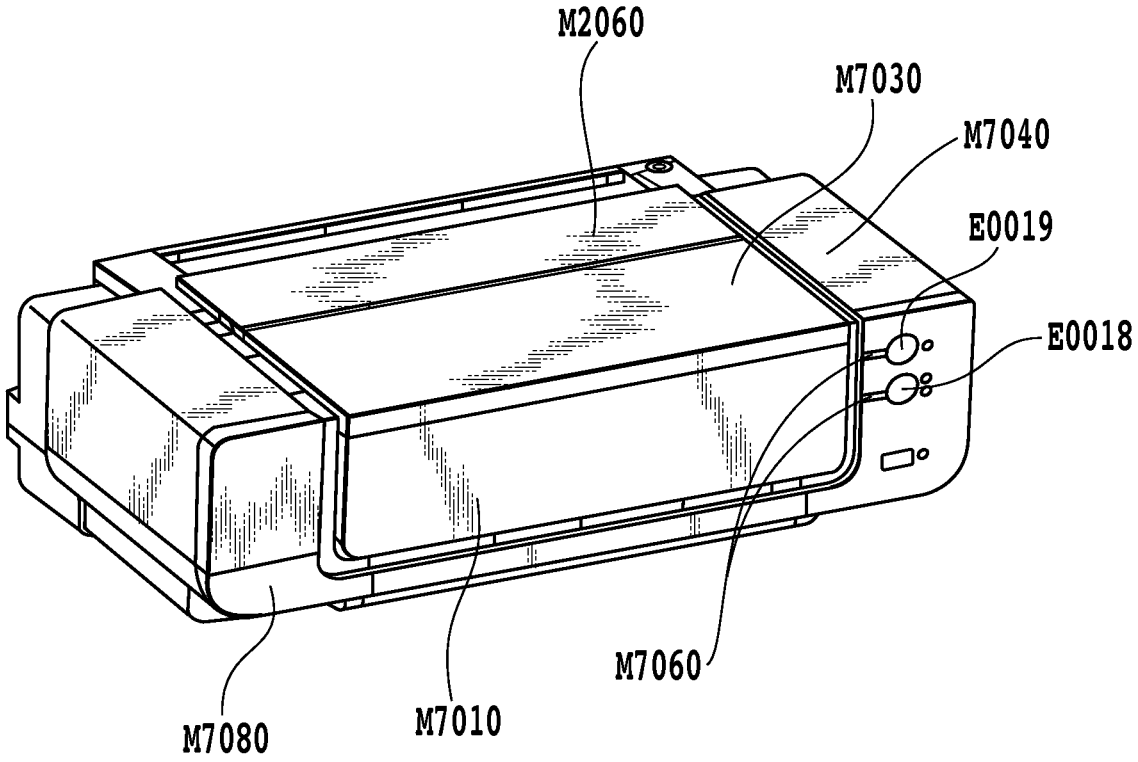
FIG. 1 is a perspective view of the printing apparatus used in one embodiment of the present invention, and shows the printing apparatus in an unused condition when viewed from the front.

Descriptions will be provided below for embodiments of the present invention by referring to the drawings.

1 Basic Configuration of Mechanisms

Descriptions will be provided for a configuration of the mechanisms in the printing apparatus to which this embodiment is applied. The main body of the printing apparatus of this embodiment is divided into a sheet feeding section (feeder), a sheet conveying section, a sheet discharging section, a carriage section, a flat path printing section and the like from a viewpoint of functions performed by the mechanisms. These mechanisms are contained in an outer case.

Figure 2:
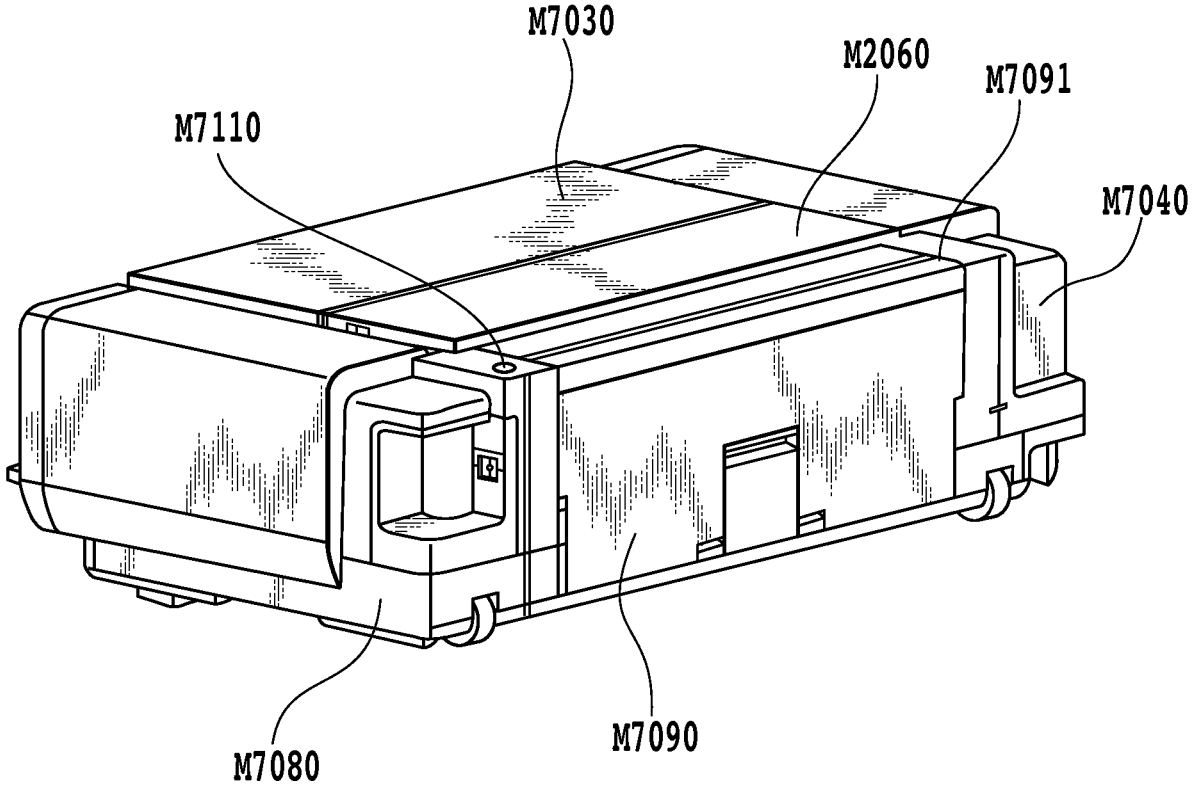
FIG. 2 is another perspective view of the printing apparatus used in the embodiment, and shows the printing apparatus in the unused condition when viewed from the back.
Figure 3:
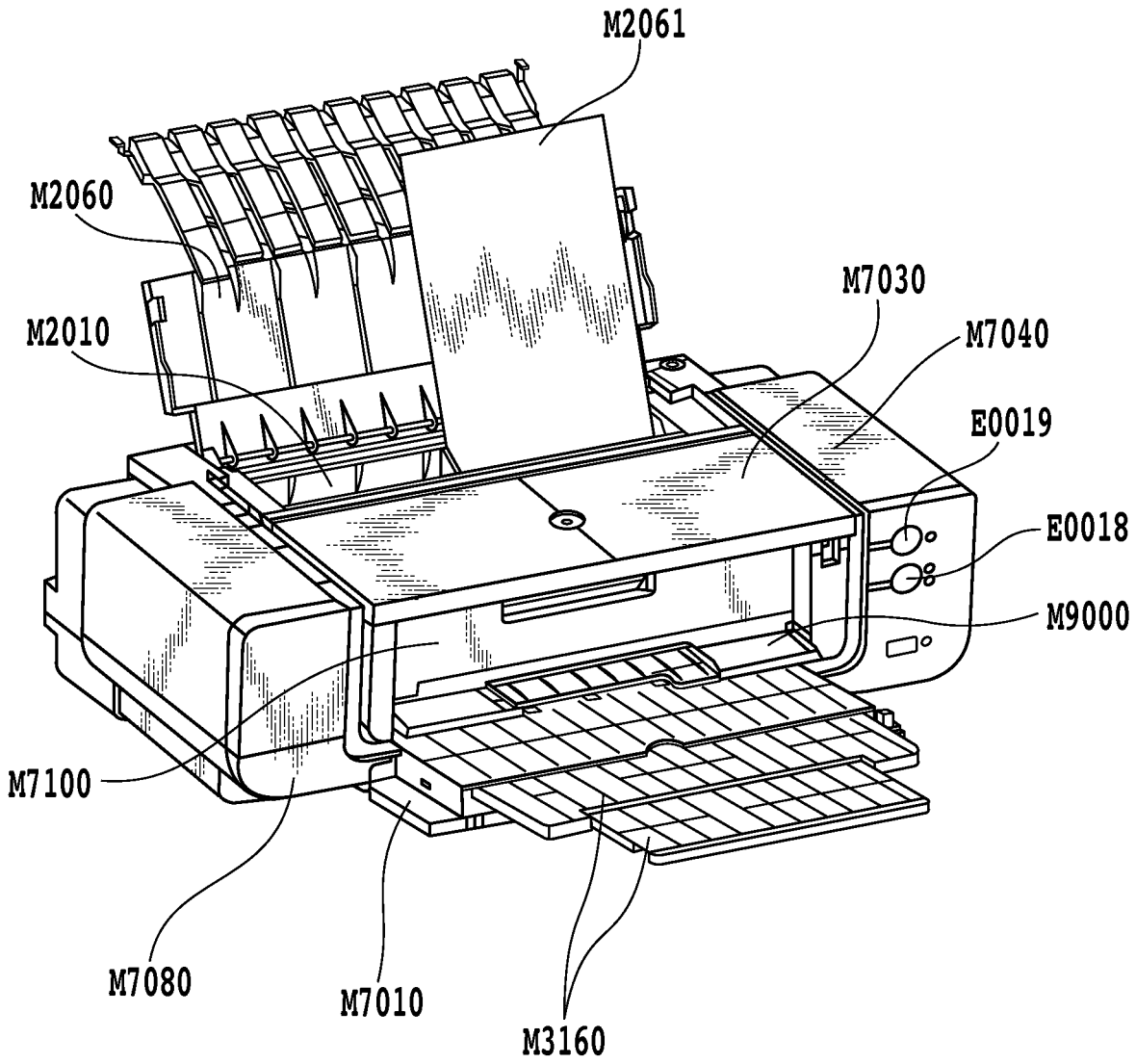
FIG. 3 is yet another perspective view of the printing apparatus used in the embodiment, and shows the printing apparatus in a used condition when viewed from the front.
Figure 4:
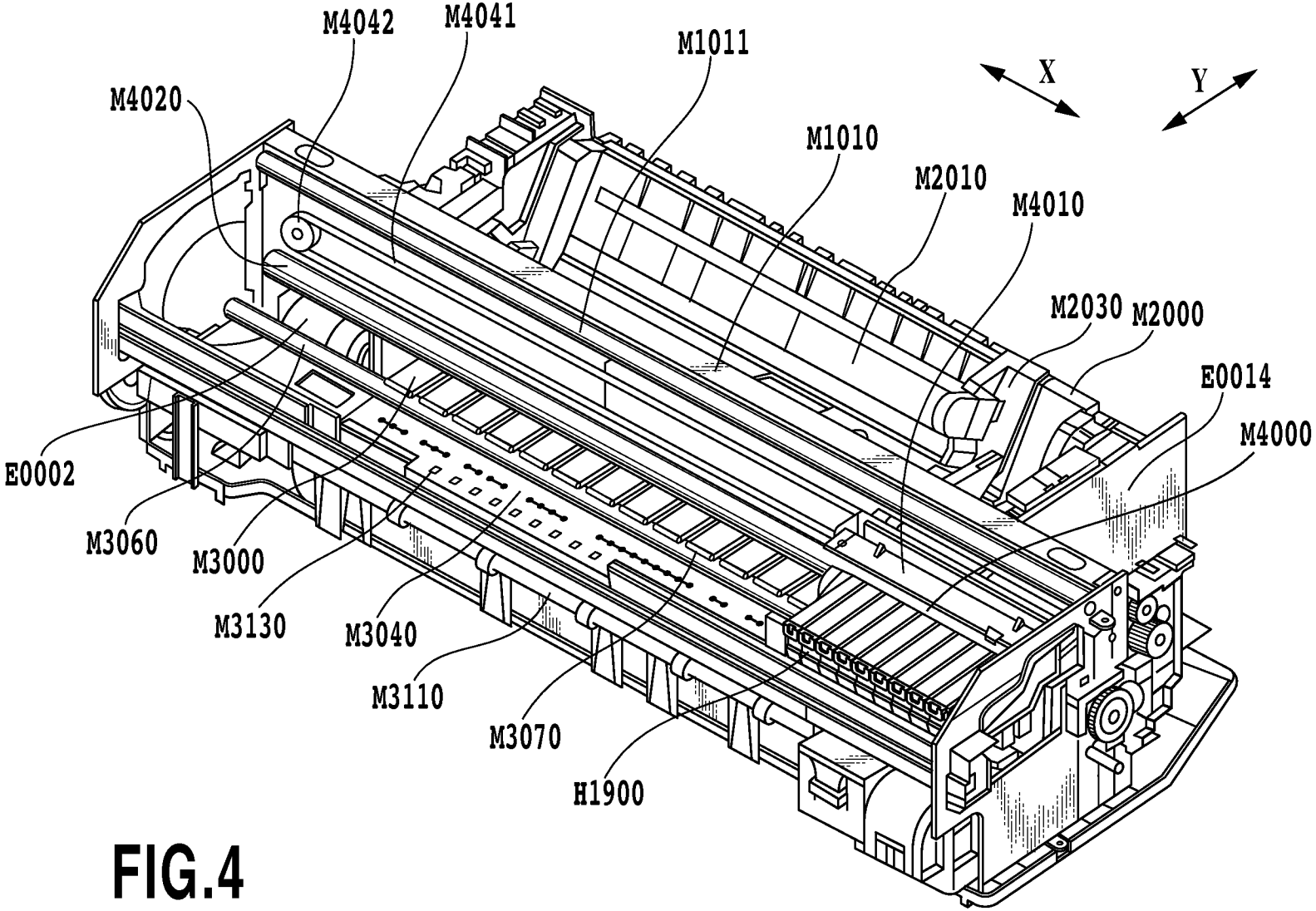
FIG. 4 is a diagram for explaining an internal mechanism of the main body of the printing apparatus used in the embodiment, and is a perspective view showing the printing apparatus when viewed from the right above.
Figure 5:
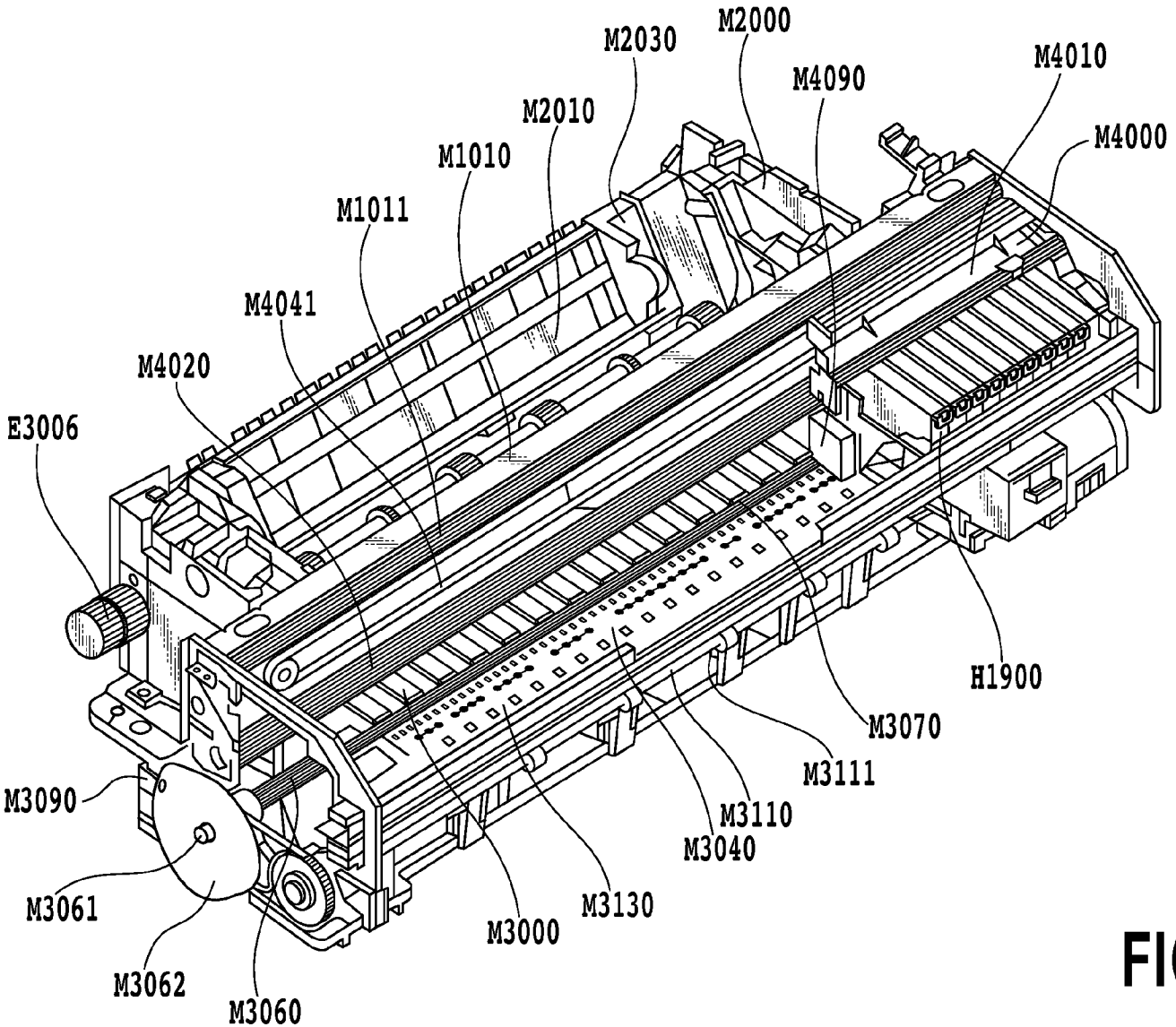
FIG. 5 is another diagram for explaining the internal mechanism of the main body of the printing apparatus used in the embodiment, and is another perspective view showing the printing apparatus when viewed from the left above.
Figure 6:
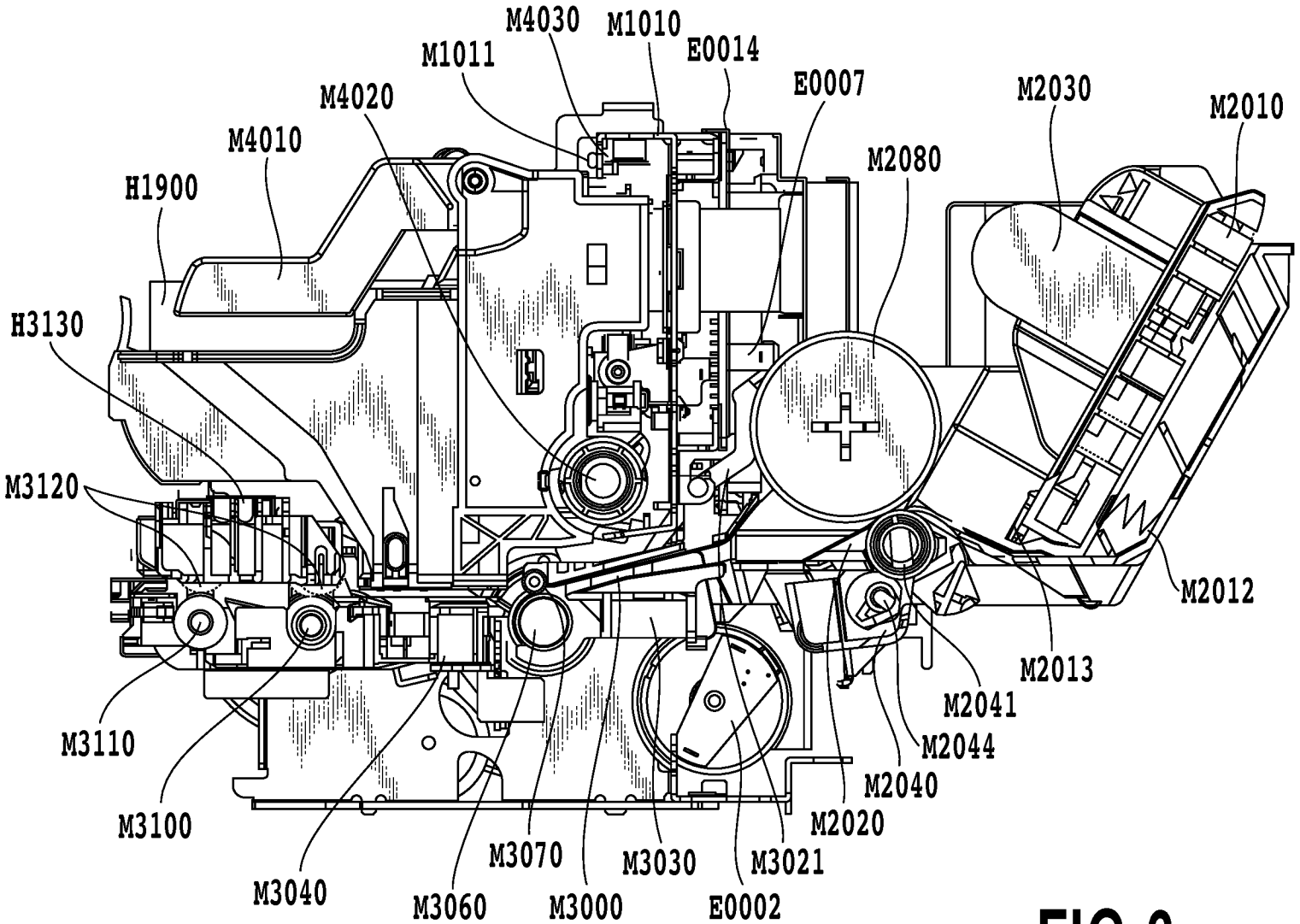
FIG. 6 is a side, cross-sectional view of the main body of the printing apparatus used in the embodiment for the purpose of explaining the internal mechanism of the main body of the printing apparatus.

FIGS. 1, 2, and 3 are perspective views respectively showing appearances of the printing apparatus to which this embodiment is applied. FIG. 1 shows the printing apparatus in an unused condition when viewed from the front. FIG. 2 shows the printing apparatus in an unused condition when viewed from the back. FIG. 3 shows the printing apparatus in a used condition when viewed from the front. In addition, FIGS. 4 to 6 are diagrams for describing internal mechanisms in a main body of the printing apparatus. In this respect, FIG. 4 is a perspective view showing the printing apparatus when viewed from the right above. FIG. 5 is a perspective view showing the printing apparatus when viewed from the left above. FIG. 6 is a side, cross-sectional view of the main body of the printing apparatus.

Descriptions will be provided for each of the sections by referring to these figures whenever deemed necessary.

(A) Outer Case (Refer to FIGS. 1 and 2)

The outer case is attached to the main body of the printing apparatus in order to cover the sheet feeding section, the sheet conveying section, the sheet discharging section, the carriage section, and the flat path section. The outer case is configured chiefly of a lower case M7080, an upper case M7040, an access cover M7030, a connector cover, and a front cover M7010.

Sheet discharging tray rails (not illustrated) are provided under the lower case M7080, and thus the lower case M7080 has a configuration in which a divided sheet discharging tray M3160 is capable of being contained therein. In addition, the front cover M7010 is configured to close the sheet discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (described later) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat path key E3004 and the like. The door switch lever detects whether the access cover M7030 is opened or closed. Each of the LED guides M7060 transmits, and displays, light from the respective LEDs. Furthermore, a multi-stage sheet feeding tray M2060 is turnably attached to the upper case M7040. While the sheet feeding section is not used, the sheet feeding tray M2060 is contained within the upper case M7040. Thus, the upper case M7040 is configured to function as a cover for the sheet feeding section.

The upper case M7040 and the lower case M7080 are attached to each other by elastic fitting claws. A part provided with a connector portion therebetween is covered with a connector cover (not illustrated).

Sheet Feeding Section (Refer to FIGS. 3 and 6)

As shown in FIGS. 3 and 6, the sheet feeding section is configured as follows. A pressure plate M2010, a sheet feeding roller M2080, a separation roller M2041, a return lever M2020 and the like are attached to a base M2000. The pressure plate M2010 is that on which printing media are stacked. The sheet feeding roller M2080 feeds the printing media sheet by sheet. The separation roller M2041 separates a printing medium. The return lever M2020 is used for returning the printing medium to a stacking position.

Sheet Conveying Section (Refer to FIGS. 3 to 6)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A sheet guide flapper M3030 and a platen M3040 are disposed in an inlet to which a printing medium is conveyed. The sheet guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper-sheet end sensor (hereinafter referred to as a "PE sensor") E0007 fixed to the chassis M1010. The platen M3040 is attached to the chassis M1010, and is positioned thereto. The sheet guide flapper M3030 is capable of rotating about a bearing unit (not illustrated), and is positioned to the chassis M1010 by abutting on the chassis M1010.

The printing head H1001 as a printing unit is moved at a side downstream in a direction in which the conveying roller M3060 conveys the printing medium.

Descriptions will be provided for a process of conveying printing medium in the printing apparatus with the foregoing configuration. A printing medium sent to the sheet conveying section is guided by the pinch roller holder M3000 and the sheet guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the sheet discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (lines/inch).

Sheet Discharging Section (Refer to FIGS. 3 to 6)

The sheet discharging section is configured of a first sheet discharging roller M3100, a second sheet discharging roller M3110, a plurality of spurs M3120 and a gear train.

The first sheet discharging roller M3100 is configured of a plurality of rubber portions provided around the metal shaft thereof. The first sheet discharging roller M3100 is driven by transmitting the driving force of the conveying roller M3060 to the first sheet discharging roller M3100 through an idler gear.

The second sheet discharging roller M3110 is configured of a plurality of elastic elements M3111, which are made of elastomer, attached to the resin made shaft thereof. The second sheet discharging roller M3110 is driven by transmitting the driving force of the first sheet discharging roller M3100 to the second sheet discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the sheet discharging rollers M3100 and M3110 at predetermined pressures. This configuration enables the spurs 3120 to rotate to follow the two sheet discharging rollers M3100 and M3110. Some of the spurs M3120 are provided at the same positions as corresponding ones of the rubber portions of the first sheet discharging roller M3110 are disposed, or at the same positions as corresponding ones of the elastic elements M3111 are disposed. These spurs chiefly generate a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the sheet discharging rollers M3100 and M3110.

With the foregoing configuration, a printing medium on which an image is formed is pinched with nips between the first sheet discharging roller M3110 and the spurs M3120, and thus is conveyed. Accordingly, the printing medium is delivered to the sheet discharging tray M3160 and supported thereon. The sheet discharging tray M3160 is divided into a plurality of parts, and has a configuration in which the sheet discharging tray M3160 is capable of being contained under the lower case M7080 which will be described later. When used, the sheet discharging tray M3160 is drawn out from under the lower case M7080. In addition, the sheet discharging tray M3160 is designed to be elevated toward the front end thereof, and is also designed so that the two side ends thereof are held at a higher position. The design enhances the stackability of printing media, and prevents the printing surface of each of the printing media from being rubbed.

Carriage Section (Refer to FIGS. 4 to 6)

The carriage section includes a carriage M4000 to which the printing head H1001 is attached. The carriage M4000 is supported with a guide shaft M4020 and a guide rail M1011. The guide shaft M4020 is attached to the chassis M010, and guides and supports the carriage M4000 so as to cause the carriage M4000 to perform reciprocating in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 8). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 8). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 8). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a disc medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats first and second operations. During the first operation, the carriage M4000 moves in the row direction while the printing head H1001 is making a print. During the second operation, the printing medium is conveyed in the column direction by conveying roller M3060. Thereby, the printing apparatus is configured to form an image on the printing medium.

Head Cartridge

The head cartridge H1000 is detachably mounted on the carriage M4000. The head cartridge H1000 in this embodiment includes the printing head H1001, a unit for mounting the ink tanks H1900 on the printing head H1001, and a unit for supplying inks from the respective ink tanks H1900 to the printing head H1001.

In the printing apparatus of this embodiment, the printing head H1001 has a configuration in which a plurality of ejecting portions are formed integrally into one unit. The plurality of ejecting portions corresponding respectively to a plurality of colors, and each of the plurality of ejecting portions is capable of ejecting an ink of one color. Each of the plurality of ejecting portions has 768 nozzles arranged in a direction crossing to the carriage moving direction to allow printing with a density of 1200 dpi (dots/inch) per one color.

Figure 7:
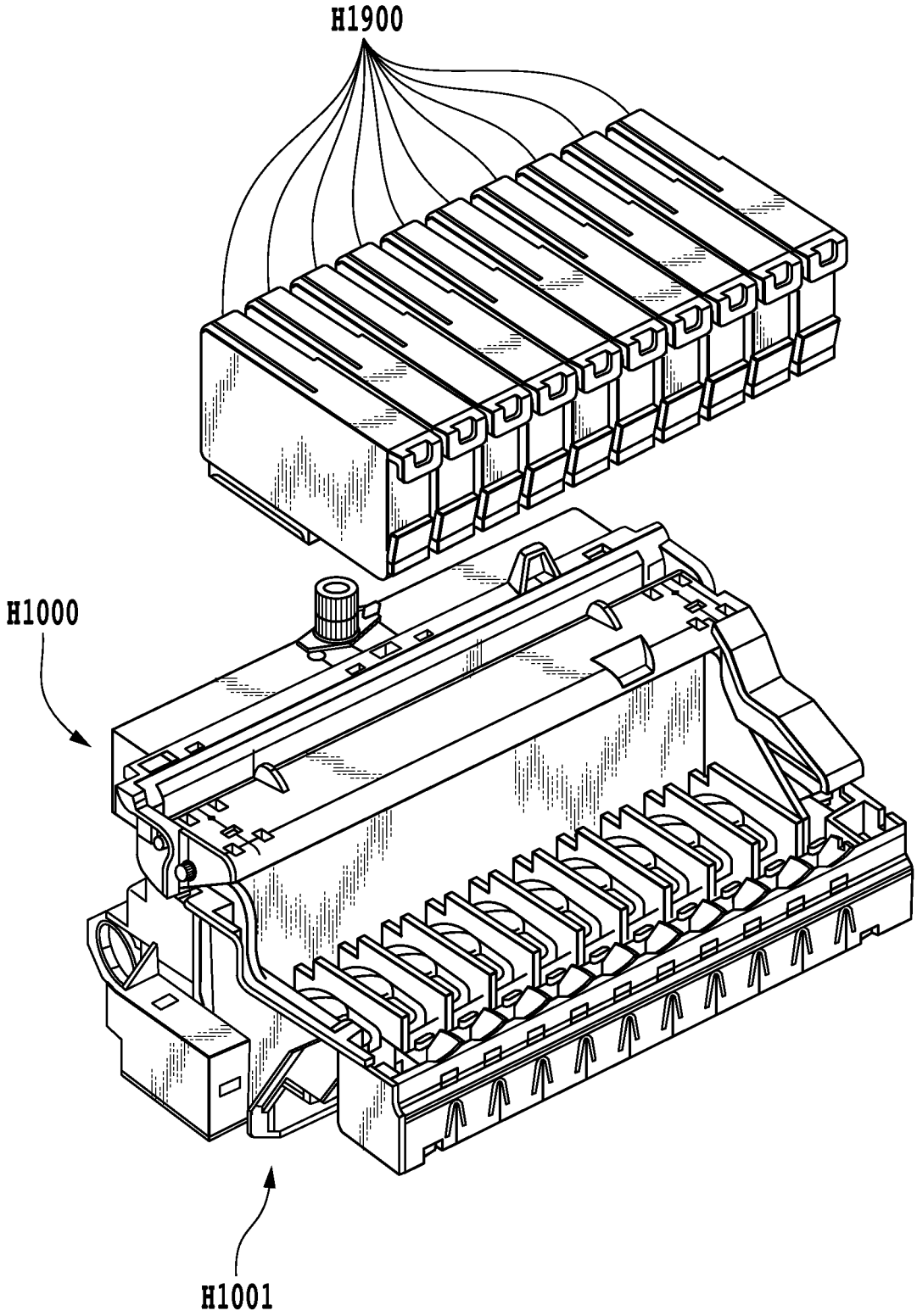
FIG. 7 is a perspective view for explaining a construction of a head cartridge employed in the embodiment.

FIG. 7 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 7, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

Other Mechanisms

In addition to the above mechanisms, the printing apparatus of the present embodiment is provided with an ejection recovery unit as a mechanism to be used to maintain or recover an ejection performance of the printing head H1001. The ejection recovery unit may have a cap for capping an ejection-opening forming face of the printing head, a pump operable to apply suction force onto the ejection openings to forcibly discharge ink therefrom in the capping state, and a mechanism for contacting/disparting the cap with/from the ejection-opening forming face. Further, the ejection recovery unit may have a wiper to wipe the ejection-opening forming face thereby wiping off ink and dust remained thereon.

Further, the printing apparatus is provided with a flat path section as a substantial unit of the present invention. This flat path section will be described later.

1 Configuration of Electrical Circuit

Descriptions will be provided next for a configuration of an electrical circuit of this embodiment.

Figure 8:
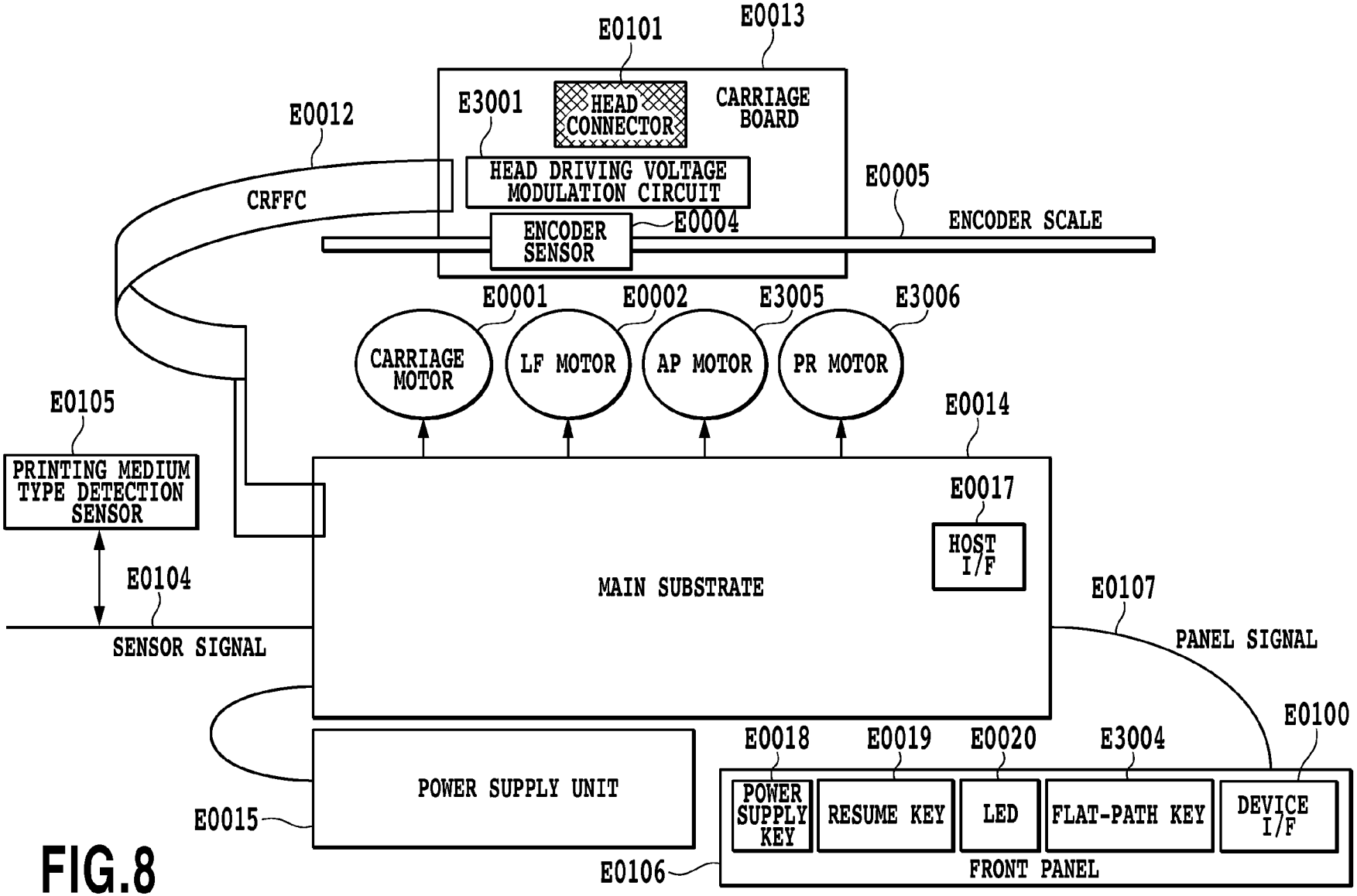
FIG. 8 is a block diagram schematically showing the entire configuration of an electrical circuit in the embodiment of the present invention.

FIG. 8 is a block diagram for schematically describing the entire configuration of the electrical circuit in the printing apparatus J0013. The printing apparatus of this embodiment is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFEC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from a host apparatus J0012.

The host apparatus J0012 is in the form of a computer which generates image data indicating an image to be printed, and which sets up a user interface (UI) for generating the data. Programs operated with an operating system of the host apparatus J0012 include an application and a printer driver. An application executes a process of generating image data with which the printing apparatus makes a print. Personal computers (PC) are capable of receiving these image data or pre-edited data which is yet to process by use of various media. These received data are displayed on a monitor of the host apparatus. Thus, an edit, a process or the like is applied to these received data by means of the application. Thereby, image data are generated. A user sets up a type of printing medium to be used for making a print, a printing quality and the like through a UI screen displayed on the monitor of the host apparatus. The user also issues a print instruction through the UI screen. Depending on this print instruction, the image data are processed by the printer driver and then transferred to the printing apparatus.

Further, the printing apparatus is provided with various motors such as the carriage motor E0001, the LF motor E0002, an AP motor E3005 and a PR motor E3006 which are appropriately controlled. The carriage motor E0001 is a motor being a driving source for moving the carriage M4000. The LF motor E0002 is a motor being a driving source for conveying the printing medium. The AP motor E3005 is a motor being a driving source for recovery operation of the printing head H1001 and for feeding operation of the printing medium. The PR motor E3006 is a motor being a driving source for flat path printing operation. Further, various sensors such as the PE sensor, a CR lift sensor, LF encoder sensor, a PG sensor and the like are connected to sensor signals E0104 for transmitting control signals thereto or receiving detection signals therefrom. A printing medium type detection sensor E0105 is provided as one of such sensors. This sensor is disposed between the sheet feeding roller M2080 and the PE sensor lever M3021 for irradiating light on the surface of the printing medium thereby detecting a material of the printing medium based on the light reflected from the printing medium. The main substrate E0014 is connected to the CREEC E0012 and a power supply unit E0015. The main substrate E0014 has an interface for transmitting information to, and receiving signals from, the front panel E0106 through panel signals E0107.

The front panel E0106 is a unit provided to the front of the main body of the printing apparatus for the sake of convenience of user's operations. The front panel E0106 includes the resume key E0019, the LED M0020, the power supply key E0018 (FIG. 1). The front panel E0106 further includes a device I/F E0100 which is used for connecting peripheral devices, such as a digital camera, to the printing apparatus.

Figure 9:
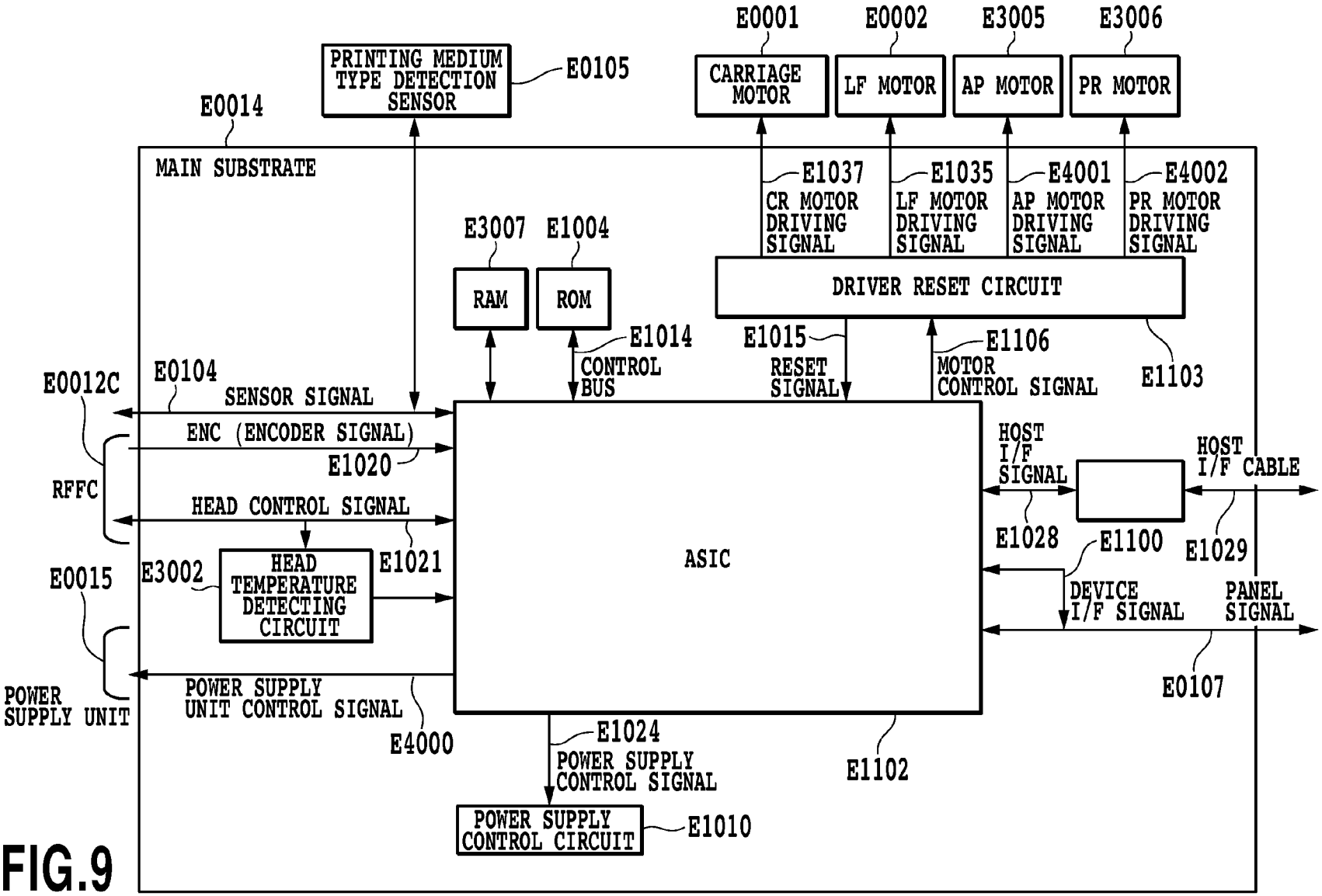
FIG. 9 is a block diagram showing an example of an internal configuration of a main substrate shown in FIG. 8.

FIG. 9 is a block diagram showing an internal configuration of the main substrate E1004.

In FIG. 9, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits or receives sensor signals E0104 concerning the various sensors including the printing medium type detection sensor E0105. Furthermore, the ASIC E1102 detects encoder signals E1020 as well as conditions of outputs from the power supply key E0018, the resume key E0019 and the flat path key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

3. Characteristic Configuration

Descriptions will be provided next for a configuration and operation of a flat path section constituting a characteristic configuration of this embodiment.

3.1 Flat-Path Section

Figure 10:
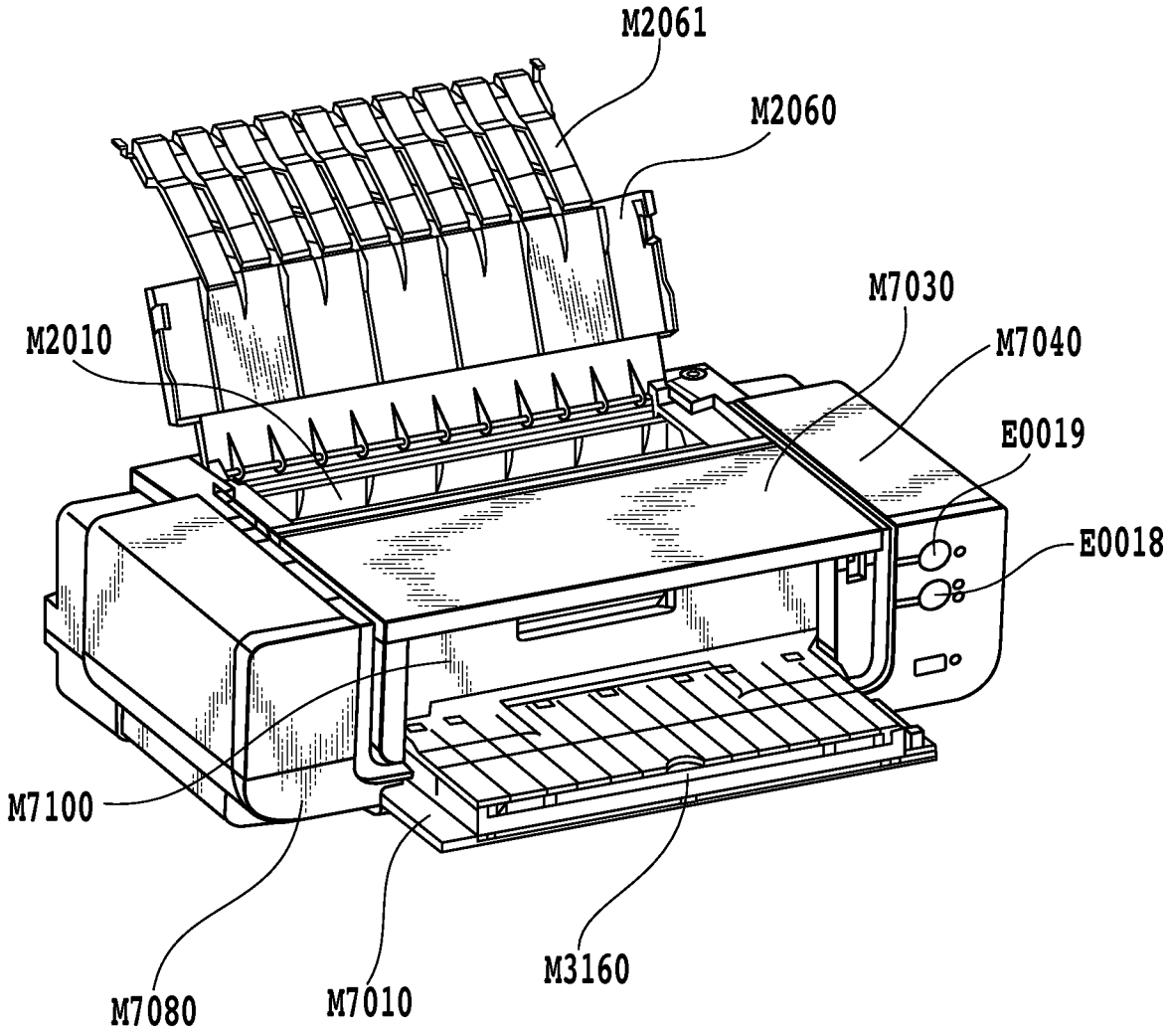
FIG. 10 is a perspective view of the printing apparatus used in an embodiment, showing the printing apparatus during flat path printing when viewed from the front.
Figure 11:
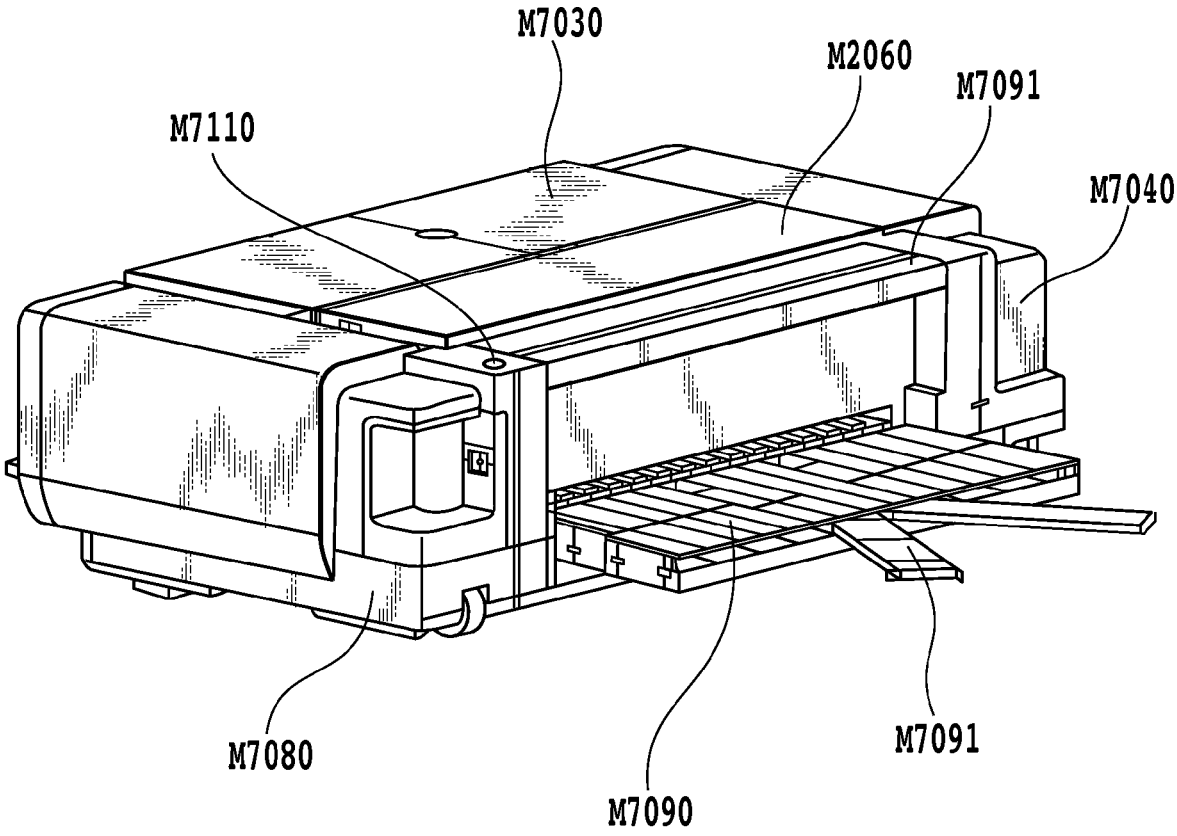
FIG. 11 is a perspective view of the printing apparatus used in the embodiment, showing the printing apparatus during the flat path printing when viewed from the back.
Figure 12:
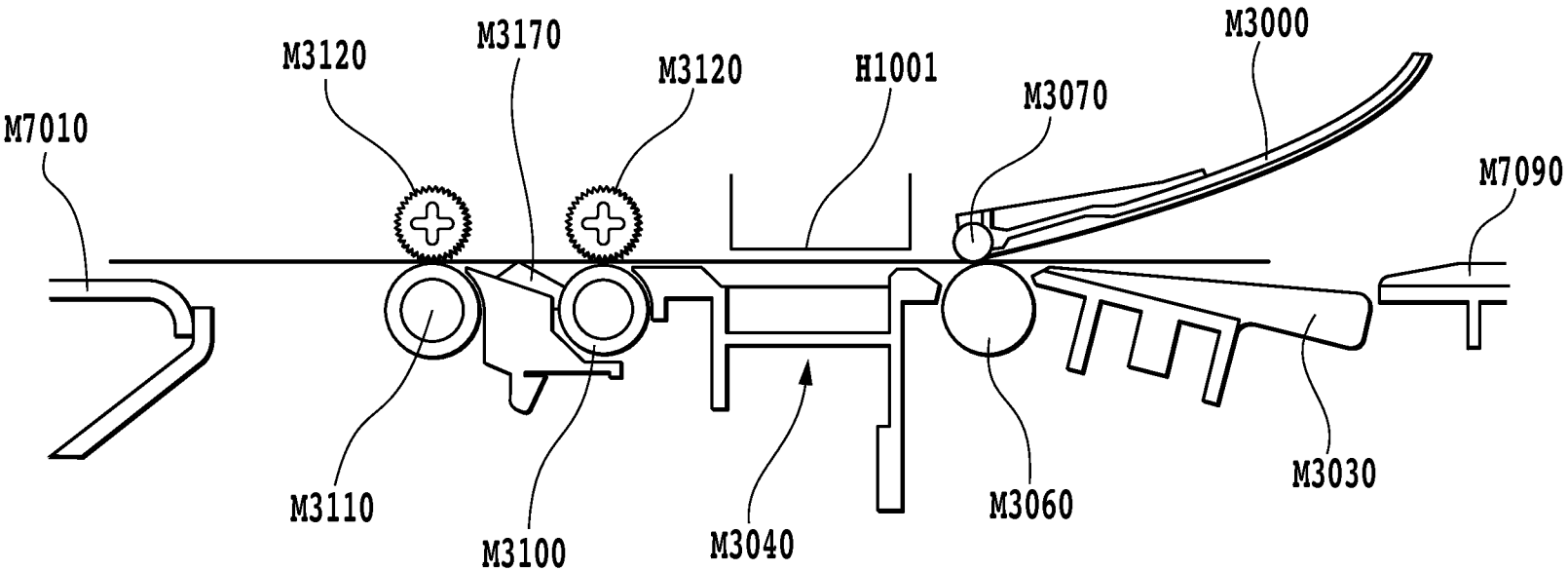
FIG. 12 is a schematic side cross sectional view for explaining the flat path printing performed in the embodiment.

FIGS. 10 and 11 show the printing apparatus of this embodiment during the flat path printing, viewed from the front and back thereof, respectively. FIG. 12 is a cross section view for explaining an internal mechanism of the main body of the printing apparatus that performs the flat path printing.

A printing medium is fed from the sheet feeding section while being bent, because the path for conveying the printing medium curves up to the pinch rollers M3070 as shown in FIG. 6. For this reason, a reaction force is generated once in the printing medium due to this bent state, and then disappears when the rear end of the printing medium gets out of this curve portion. This causes a conveyance load on the printing medium to largely vary during printing. Such variation in the conveyance load may deteriorate print quality.

To avoid such a problem, in the flat path printing of this embodiment, a printing medium is fed from the sheet feeding section, and then is further conveyed without being printed until the rear end of the printing medium gets out of the curve portion. After being conveyed to the position described above, the printing medium is reversely conveyed along the flat and horizontal conveyance path and is set in a predetermined position. Then, the printing medium is printed by being further conveyed from the predetermined position to the print position.

The front cover M7010 is usually located below the sheet delivery section, because the front cover M7010 is also used as a tray on which several tens of printing media already printed are stacked (refer to FIG. 3). In the fiat path printing, however, the front cover M7010 is lifted up to the position of the sheet discharging port so as to convey the printing medium horizontally (FIG. 10). An unillustrated hook or the like is provided to the front cover M7010 and is used to fix the front cover M7010 to a flat path sheet feeding position. A sensor can detect that the front cover M7010 is in the flat path sheet feeding position. Thus, according to the detection, it can be determined that the current mode is the flat path printing mode.

Moreover, A rear tray M7090 can be opened by pressing a rear tray button M7110. Further, a rear sub-tray M7091 can be opened in the form of the letter V (refer to FIG. 11). The rear tray M7090 and the rear sub-tray M7091 are trays for supporting a long printing medium on the back side of the main body of the printing apparatus in the case where the long printing medium juts out from the back side of the main body while being conveyed reversely. Unless a thick printing medium is kept flat during printing, the conveyance load may vary. This is likely to adversely affect the print quality. For this reason, the provision of these trays is effective. However, if a printing medium is short enough not to jut out of the back side of the main body of the printing apparatus, the rear tray M7090 and the like do not need to be opened.

The flat path conveyance of a printing medium is ready to start by setting the front cover M7010 in the up position (and also by opening the rear tray M7090, if needed), as described above. At this time, the flat path is approximately horizontal as shown in FIG. 12.

Figure 13A:
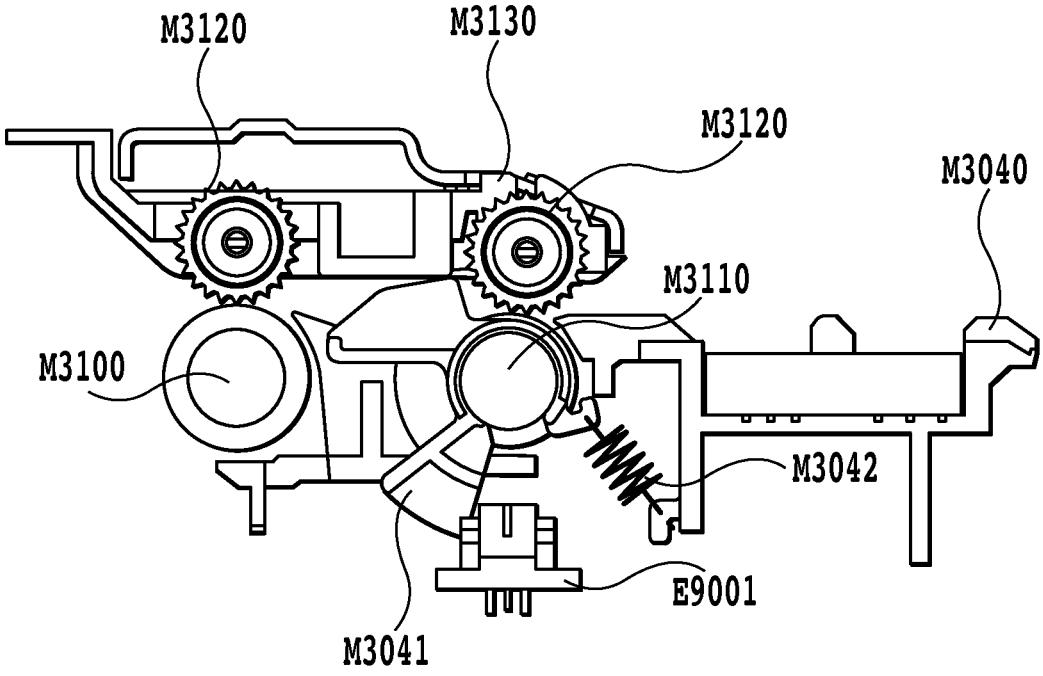
FIGS. 13A and 13B are views for explaining a configuration and operation of a FPPE sensor lever that operates a sensor (FPPE sensor) for detecting an end of a printing medium in the flat path printing.
Figure 13B:
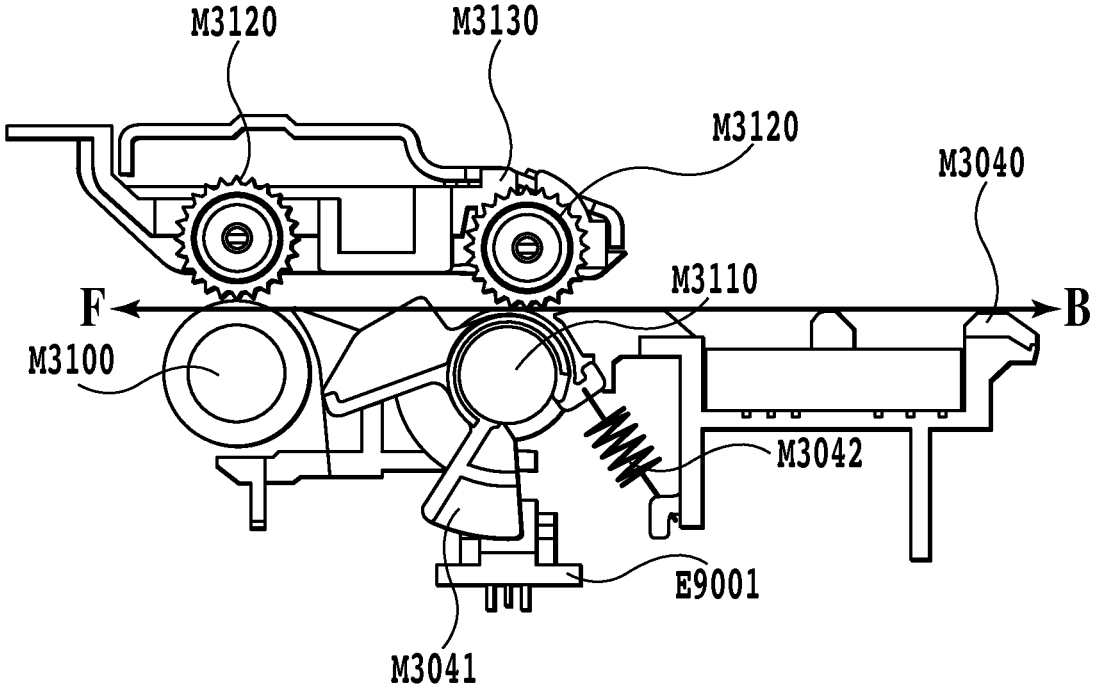

FIGS. 13A and 13B are views for providing detailed descriptions of an FPPE sensor lever M3041 that operates a sensor E9001 (FPPE sensor) for detecting a rear end of a printing medium in the flat path printing. The FPPE sensor lever M3041 is configured to be rotatable about the second sheet delivery roller M3110. When no printing medium is conveyed, the FPPE sensor lever M3041 is biased to a position shown in FIG. 13A by the action of an FPPE sensor lever spring M3042. When the FPPE sensor lever M3041 is located in this position, a light shield plate of the FPPE sensor lever M3041 does not block a light path of the FPPE sensor E9001 in the form of a transmissive-type optical sensor.

In this embodiment, a printing medium is conveyed in a direction F shown in FIG. 13B when being fed from the sheet feeding section and when being fed in the flat path printing. When the printing medium is conveyed from the platen M3040 in the F direction, a leading end of the printing medium rotates the FPPE sensor lever M3041 about the second sheet delivery roller M3110 in the counterclockwise direction in FIG. 13B. With this rotation, the light shield plate of the FPPE sensor lever M3041 comes to a position where the light path of the FPPE sensor E9001 is blocked. At a timing of being blocked, the FPPE sensor E9001 detects the end of the printing medium. On the other hand, when a printing medium is again drawn back to the inside of the main body for the flat path printing, the printing medium is conveyed in a direction B in FIG. 13B. Also, in this case, a leading end of the printing medium rotates the FPPE sensor lever M3041 and thereby the FPPE sensor E9001 detects the end of the printing medium.

With the foregoing configuration, the front or the rear end of the printing medium can be detected. Note that, the aforementioned PE sensor lever M3021 is also rotated by an end of the printing medium, and the PE sensor E0007 is enabled to detect the front or rear end of a printing medium in the direction F and in the direction B shown in FIG. 13B, according to a detection that the light path of the PE sensor E0007 is in the light blocked state or in the light passing state.

Figure 14A:
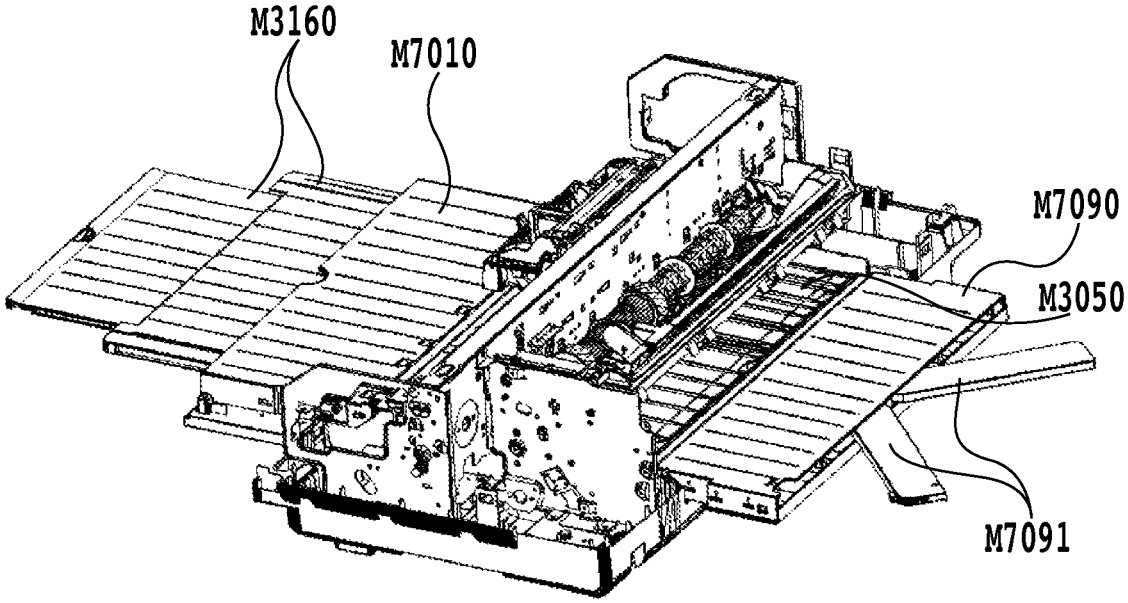
FIGS. 14A and 14B are perspective views showing a schematic configuration of a mechanism related to conveyance in the flat path printing.
Figure 14B:
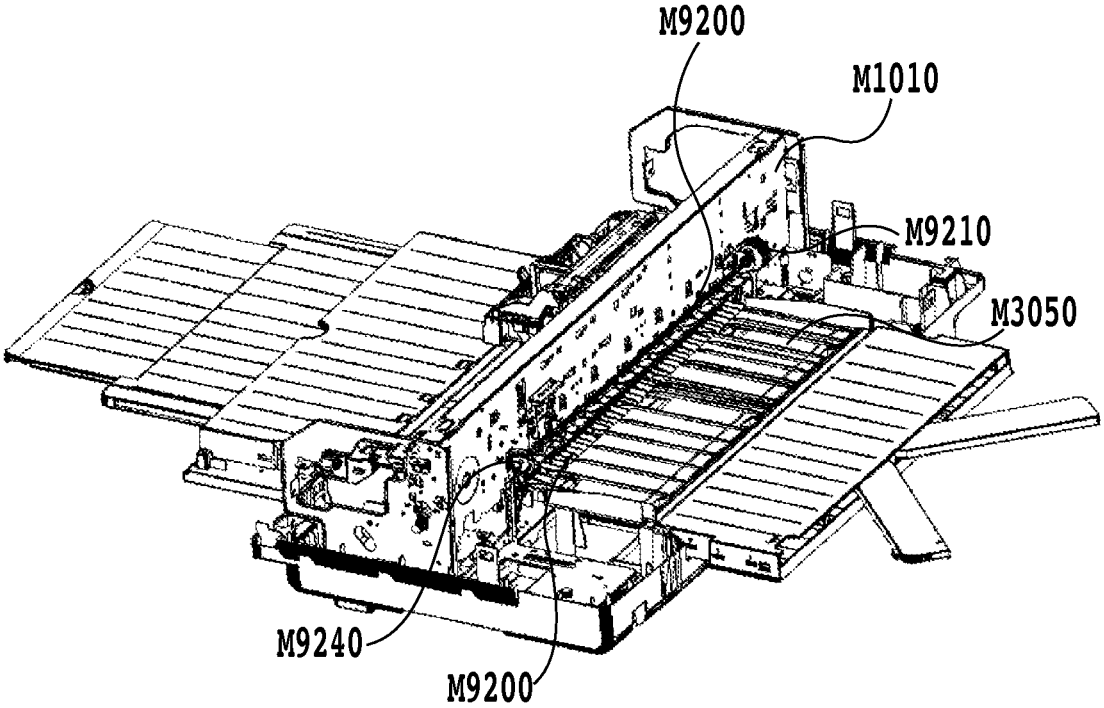

FIGS. 14A and 14B are perspective views showing a schematic configuration of a mechanism related to conveyance in the flat path printing. FIG. 14A is a perspective view of the mechanism from the back side when the upper case M7040 is detached from the printing apparatus main body, and FIG. 14B is a perspective view of the mechanism when the sheet feeding section is further detached from the printing apparatus main body in FIG. 14A.

FIG. 14A shows that a flat conveyance path (flat path) for a printing medium is formed by the sheet delivery tray M3160, the front cover M7010, the platen M3040, the sheet guide flapper M3030, the flat path guide M3050, the rear tray M7090 and the rear sub-tray M7091. In FIG. 14B, a PGF input gear M9210 is pivotally and rotatably supported by the chassis M1010 with a sheet guide flapper rotation shaft (hereinafter, referred to as a PGF rotation shaft) M9200.

Moreover, a cam-shaped portion M9211 for pressing down one end of the sheet guide flapper M3030 is integrally formed on the PGF input gear M9210 located at one end of the PGF rotation shaft M9200. In addition, a sheet guide flapper release cam (hereinafter, referred to as a PGF release cam) M9240 for pressing down the other end of the sheet guide flapper M3030 is provided at the other end of the PGF rotation shaft M9200. These two cam-shaped portions have symmetrical shapes, and press down the sheet guide flapper M3030 at the same timing. Thus, a surface of the sheet guide flapper M3030 on which a printing medium is conveyed is positioned approximately horizontal, whereby the flat path is formed.

The PGF input gear M9210 is further provided with an unillustrated rib with a cylindrical shape. With the rotation of the PGF rotation shaft M9200, the rib covers and uncovers an unillustrated sheet guide flapper sensor being an infrared sensor, whereby the rotation angle of the PGF rotation shaft M9200 can be detected.

Figure 15A:
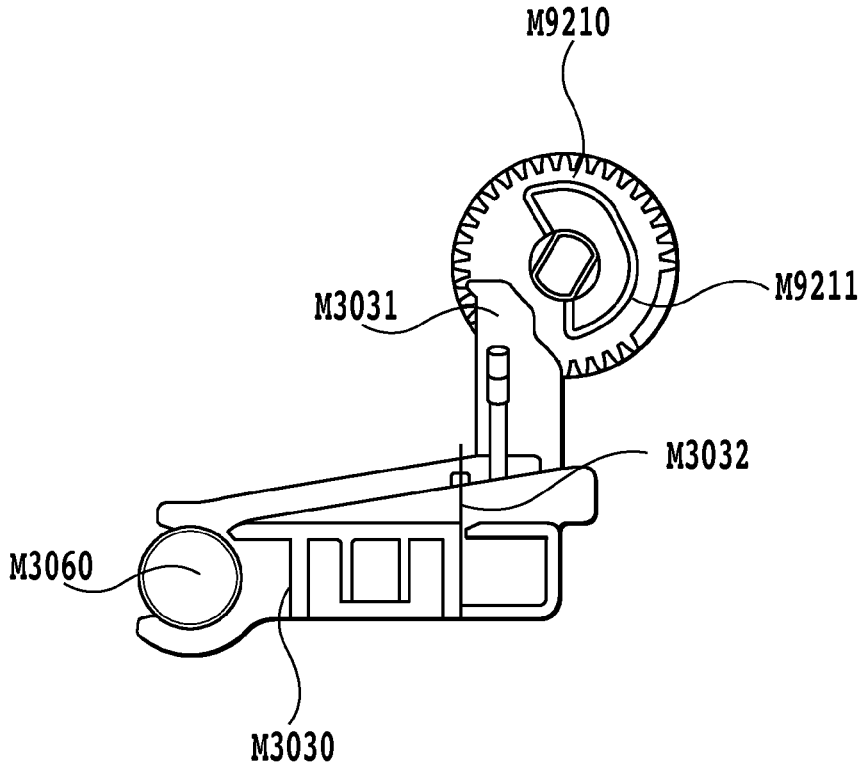
FIGS. 15A and 15B are partial cross-sectional views for schematically showing an operation of a sheet guide flapper for controlling a conveyance path.
Figure 15B:
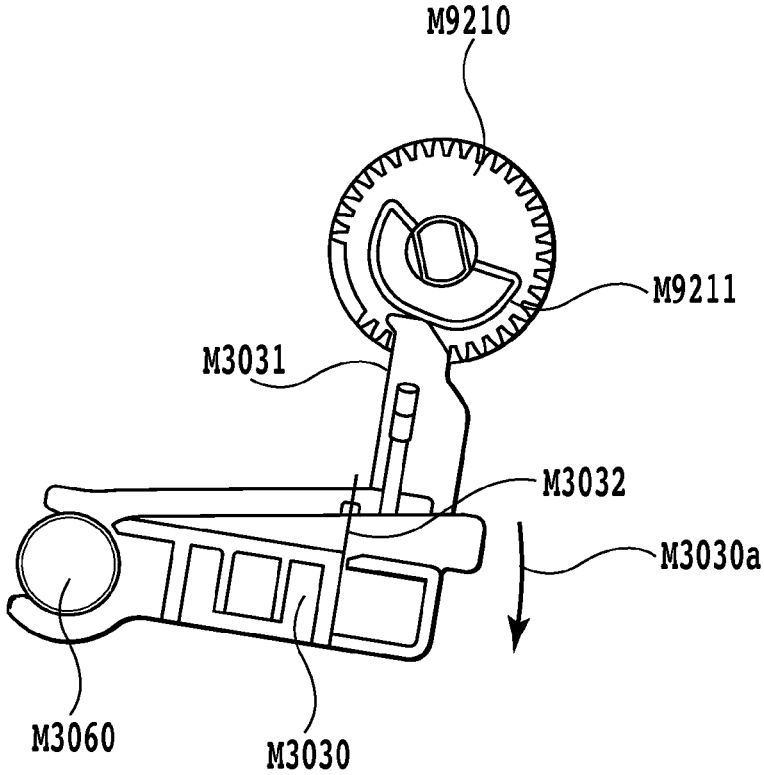

FIGS. 15A and 15B are partial cross-sectional views for schematically showing an evading operation of the sheet guide flapper M3030. FIG. 15A shows that the sheet guide flapper M3030 is lifted to guide a printing medium conveyed from the sheet feeding section. The sheet guide flapper M3030 is biased by an unillustrated spring member in a direction in which the sheet guide flapper M3030 is lifted. In addition, since the sheet guide flapper M3030 is capable of rotating about the unillustrated bearing unit as described above, the sheet guide flapper M3030 is positioned by abutting on the chassis M1010.

FIG. 15B is a partial cross-sectional view showing that the sheet guide flapper M3030 is lowered. The cam-shaped portion M9211 formed on the PGF input gear M9210, and the PGF release cam M9240 (see FIG. 14) are symmetrically formed respectively at both ends of the PGF rotation shaft M9200, as described above, and come into contact with arm portions M3031 of the sheet guide flapper M3030. With the rotations of these two cam-shaped portions, the arm portions M3031 are pressed down in a direction shown by an arrow M3030*a*, and thereby the lifted side of the sheet guide flapper M3030 is also pressed down. Consequently, the printing medium conveying surface is made approximately horizontal. During the flat path printing, a printing medium is conveyed from the sheet discharging port with the conveying surface thus made horizontal.

With the mechanism described above, the sheet guide flapper M3030 of this embodiment can change its state between the state for the sheet feeding from the sheet feeding section as shown in FIG. 15A, and the state for the flat path conveyance as shown in FIG. 15B. Such a change is made by transmission of power from the foregoing PR motor E3006.

3.2 Flat Path Printing Control

Figures 16, 16A:
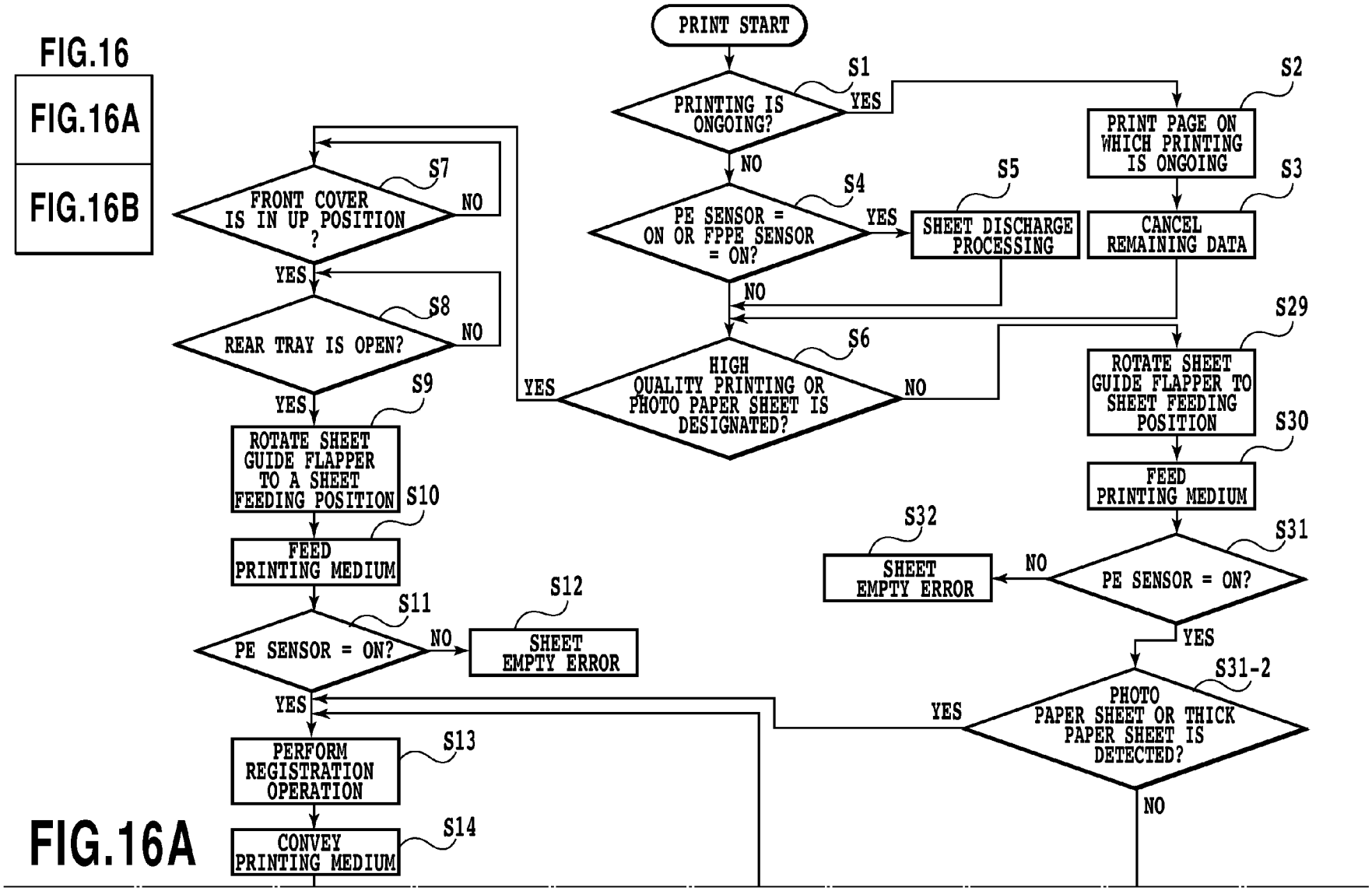
FIG. 16 is a flowchart showing the relationship of FIGS. 16A and 16B.
FIG. 16A is a flowchart for explaining an operational sequence performed by the printing apparatus of the embodiment.
Figure 16B:
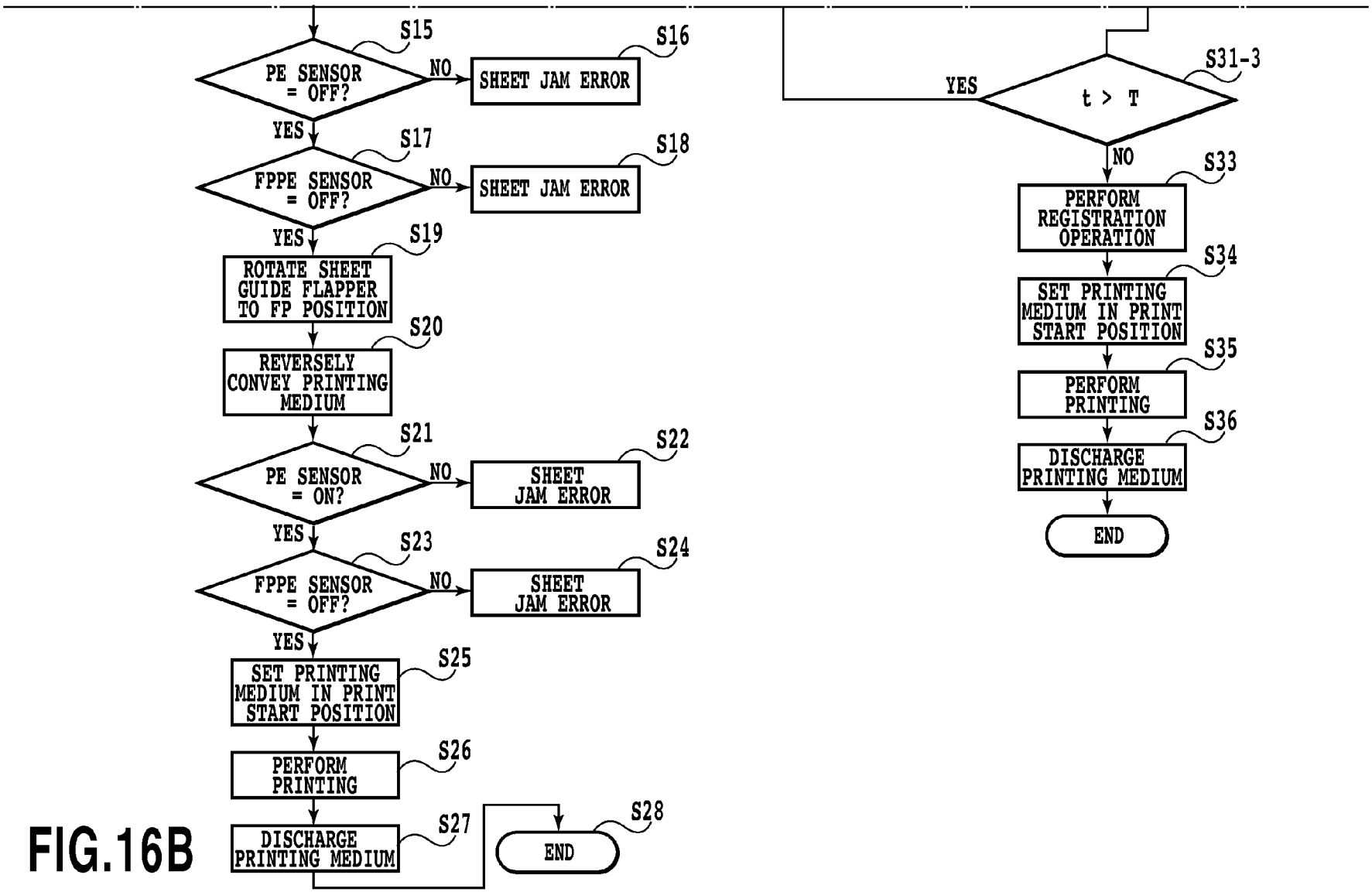
FIG. 16B is a flowchart for explaining an operational sequence performed by the printing apparatus of the embodiment.
Figure 17:
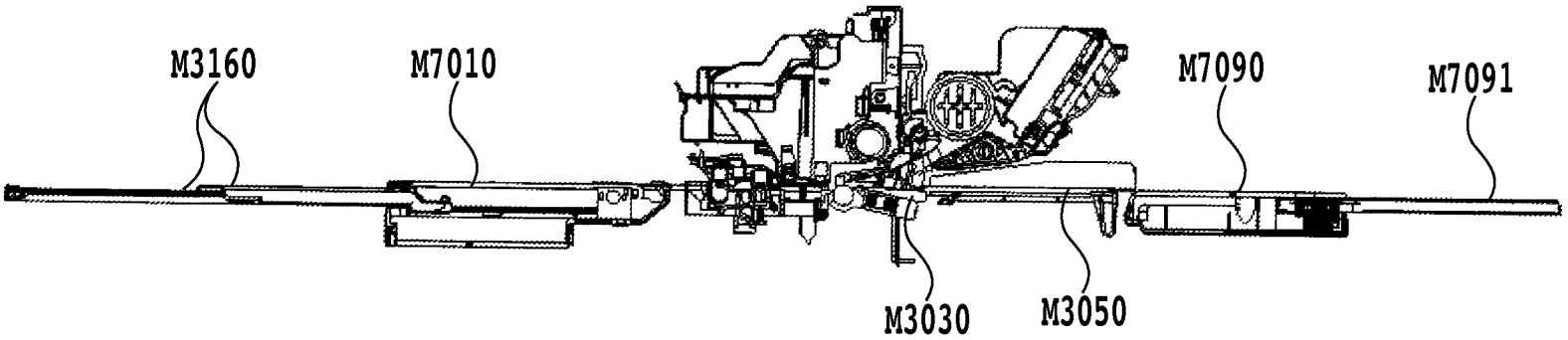
FIG. 17 is a cross-sectional view of FIG. 14A.
Figure 18A:
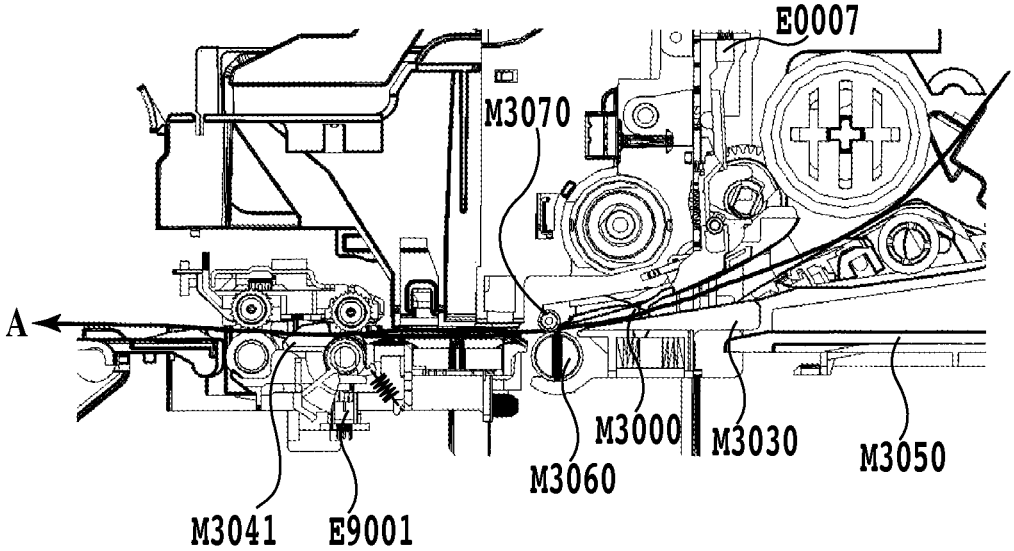
FIGS. 18A and 18B are cross-sectional views showing a conveyance path of a printing medium.
Figure 18B:
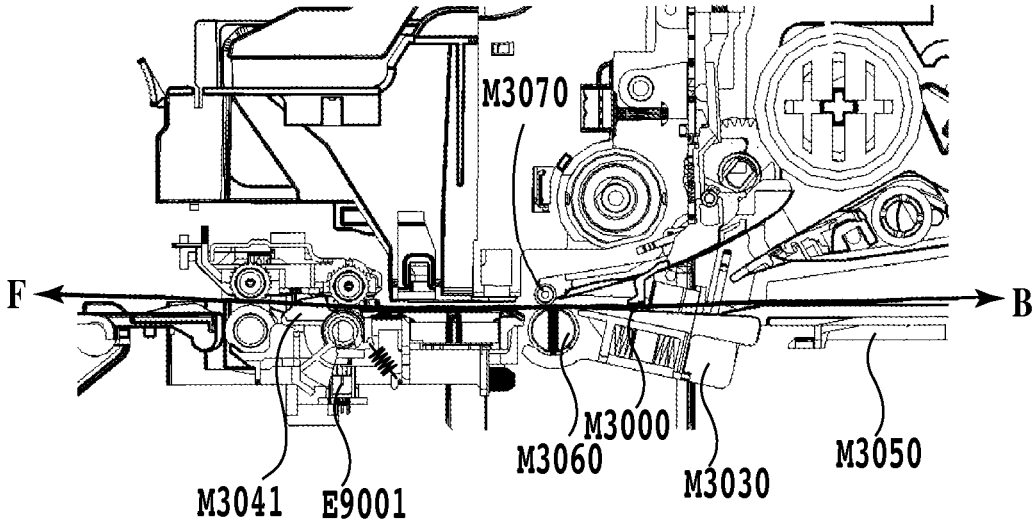

FIG. 16 is a flowchart for explaining an operational sequence performed by the printing apparatus of this embodiment. FIG. 17 is a cross-sectional view of FIG. 14A. FIGS. 18A and 18B are cross-sectional views for explaining characteristic operational states in the flowchart in FIG. 16.

In order to start the flat path printing mode, whether or not printing is currently ongoing is determined in step S1. If it is determined that the printing is ongoing, the processing moves to step S2 and the printing is continuously performed on a page whose printing is ongoing. If there is print data following data of the current page, the data is cancelled in step S3. In the printing apparatus of this embodiment, the front cover M7010 is made approximately horizontal in the flat path printing, while the front cover M7010 is configured to have its one end elevated to improve the capacity of stacking printing media discharged in the normal printing mode. If the posture of the front cover M7010 is changed during printing, such a change adversely affects the printing medium conveyance, and thereby deteriorates the print quality. To avoid this, only a single printing medium whose printing is ongoing is completely printed and then discharged in this embodiment.

If it is determined in step S1 that the printing is not ongoing, the processing moves to step S4 and both outputs of the PE sensor E0007 and the FPPE sensor E9001 are checked. Even when it is determined in step S1 that the printing is not ongoing, a printing medium previously printed may remain in the sheet conveying section. For this reason, in this embodiment, a final confirmation as to the presence of a printing medium is made by use of the two sensors just in case. If any one of the sensors detects the presence of a printing medium (ON state), the processing goes to step S5 and the discharge processing of the printing medium is performed. Upon completion of all these steps, it is definitely sure that no sheet remains in the printing medium conveyance path.

In step S6, a designated print quality and printing medium type are checked in reference to a print control signal from a host apparatus J0012. When the designated print quality is high or when the designated printing medium type is photo paper, the processing goes to step S7. Otherwise, the processing goes to step S29. This embodiment employs the sequence in which the processing goes to step S7 if any one of the designated print quality and printing medium type is determined as matching a predetermined condition for the flat path printing in step S6. Instead, the processing may go to step S7 only if both of them match their respective predetermined conditions for the flat path printing.

Step 7 to step 28 are for a flat path printing operation, while step 29 to step 36 are for a normal printing operation.

When the processing goes to step 7, the position of the front cover M7010 is detected based on a sensor output in order to perform the flat path printing. Moreover, whether the rear tray M7090 is open or close is detected based on a sensor output in step S8. After confirming that the front cover M7010 is in the flat path position in step S7 and confirming that rear tray M7090 is open in step S8, the processing goes to step S9.

In step S9, the sheet guide flapper M3030 is rotated to a sheet feeding position in order to receive a printing medium fed from the sheet feeding section. FIG. 18A shows a state in which the sheet guide flapper M3030 is located in the sheet feeding position after rotation in step S8. In this state, the printing medium conveyance path from the sheet feeding section to the sheet conveying section is continuously formed in a direction of an arrow A in FIG. 18A.

In subsequent step S10, a printing medium stacked on the sheet feeding section is fed. In step S11, the front end of the fed printing medium is detected based on the output from the PE sensor E0007. A failure in detecting the front end of the printing medium in step S11 means that no printing medium is set on the sheet feeding section. Thus, the processing goes to step S12, and the operation is terminated as a SHEET EMPTY error.

If the front end of the printing medium is detected in step S11, the printing medium is conveyed by a predetermined distance up to a nip portion between the conveying roller M3060 for generating a force of conveying the printing medium, and the pinch rollers M3070. Then, in step S13, the front end of the printing medium comes into contact with the nip portion between the conveying roller M3060 and the pinch rollers M3070 (these rollers are not rotated at this time), whereby the front end of the printing medium is aligned in a direction perpendicular to the conveyance direction. In this way, an operation for correcting oblique conveyance of the printing medium (also called "a registration operation") is performed herein, the oblique conveyance mainly being attributed to the sheet feeding section. The printer apparatus for the conventional flat path printing is configured to require a user to set a printing medium on the flat path, and thereby is incapable of performing such an oblique conveyance correction operation by itself. In this embodiment, however, the printer apparatus feeds a printing medium from the sheet feeding section, and thus is enabled to perform the oblique conveyance correction operation. Consequently, highly accurate conveyance of printing media can be achieved.

In subsequent step S14, the printing medium is further conveyed until the rear end of the printing medium gets out of the sheet feeding section. When the rear end of the printing medium is out of the sheet feeding section, the printing medium can be guided onto the flat path by rotating the sheet guide flapper M3030. In this embodiment, the printing medium is conveyed until the output from the PE sensor E0007 turns into the OFF state (a SHEET ABSENT STATE) in step S15. This prevents the printing medium from returning to the sheet feeding section when the printing medium is conveyed reversely in step S20. Otherwise, the rear end of the printing medium may be still in the sheet feeding section, and the printing medium may return to the sheet feeding section. Instead, if the PE sensor E0007 is in the ON state in step S15, this means that a sheet jam occurs in the course of sheet feeding. In this case, the processing goes to step S16, and the operation is terminated as a sheet jam error.

In step S17, the output from the FPPE sensor E9001 is similarly determined. If the FPPE sensor E9001 is in the OFF state (SHEET ABSENT STATE), it is determined that a sheet jam occurs between the roller pair of the conveying roller M3060 and the pinch rollers M3070 and the processing goes to step S18. Then, the operation is terminated as a sheet jam error.

In this embodiment, the distance of the printing medium conveyance is set to be such a length that the rear end of the printing medium cannot reach the nip portion between the conveying roller M3060 and the pinch rollers M3070 after the PE sensor E0007 turns into the OFF state. This setting keeps the printing medium nipped between the roller pair of the conveying roller M3060 and the pinch rollers M3070. Thus, the effect of the oblique conveyance correction operation in step S13 is also maintained.

After it is confirmed that the printing medium is normally conveyed in step S15 and S17, the sheet guide flapper M3030 is rotated in step S19 to switch the printing medium conveyance path to the flat path as shown in FIG. 18B.

In subsequent step S20, the printing medium is conveyed reversely in a direction shown by an arrow B in FIG. 18B up to the flat path formed by the bottom surface of the sheet feeding section, the flat path guide M3050 and the rear tray M7090. Also, during this reverse conveyance, the outputs from the PE sensor E0007 and the FPPE sensor E9001 are checked in step S21 and step S23, respectively If a sheet jam is determined as occurring, the processing goes to step S22 or S24 where the operation is terminated as a sheet jam error.

The distance of the printing medium reverse conveyance in step 20 is set to be such a length that the front end of the printing medium cannot reach the nip portion between the conveyance roller M3060 and the pinch rollers M3070 after the front end of the printing medium is detected by the FPPE sensor E9001. This setting keeps the printing medium nipped between the roller pair of the conveying roller M3060 and the pinch rollers M3070. Thus, the effect of the oblique conveyance correction operation in step S13 is also maintained.

In step S25, the printing medium M9900 is set in a position ready to print, that is, a print start position thereof is detected, prior to the printing operation. After that, the printing operation is normally performed in step S26 and the sheet discharge operation after the printing is performed in step S27. Then, this series of printing operation is terminated in step S28. The printing medium conveying direction in step S25 to step S28 is a direction shown by an arrow F in FIG. 18B.

On the other hand, if it is found, as a result of checking in step S6, that neither of the designated print quality nor the printing medium matches the predetermined condition, the processing goes to step S29 and the normal printing operation is performed. In this case, firstly in step S29, the sheet guide flapper M3030 is rotated to the sheet feeding position, whereby the printing medium conveyance path from the sheet feeding section to the sheet conveying section is continuously formed. Then, if the OFF state (SHEET ABSENT STATE) is detected by the PE sensor in step S31, this means that a sheet jam occurs during the sheet feeding. Accordingly, the processing goes to step S32, and the operation is terminated as a sheet jam error.

If the ON state (SHEET PRESENT STATE) is detected in step S31, the processing goes to step S31-2. In aforementioned step S6, the flat path printing operation is selected according to a signal being included in a print control signal from the host apparatus J0012, and indicating the printing medium type and printing mode. In contrast, in step S31-2, which type of printing medium is actually used as a print target is determined based on a detection result from the printing medium type detection sensor E0105, under the situation where the flat path printing is not selected as a result of step S6. Then, if the printing medium is determined as a photo paper sheet or a thick paper sheet, the processing goes to step S13 and the flat path printing is performed.

If the printing medium is determined as neither the photo paper sheet nor the thick paper sheet in step S31-2, the processing goes to step S31-3. In step S31-3, whether or not a time t is longer than a usual time is determined, under the situation where the flat path printing is not selected based on the detection result from printing medium type detection sensor E0105. Here, the time t is a time required by the PE sensor E0007 to detect the frond end of the printing medium after the sheet feeding roller M2080 starts sheet feeding. In other words, a determination is made as to whether or not the time t is longer than a predetermined time T. Then, if the determination result is affirmative, the processing goes to step S13 and the flat path printing is performed. Here, a case where the time t required until the front end of the printing medium is detected after the sheet feeding starts is longer than the usual time is considered to occur for the following reason. When a printing medium is thick and accordingly has large conveyance resistance, the printing medium may slip on the sheet feeding roller M2080 due to the large conveyance resistance. Thereby, in such a case, the flat path printing is performed. This switching to the flat path printing is effective for the case where the printing medium type detection sensor E0105 fails to detect that a printing medium is a thick paper sheet even though the printing medium is actually the thick paper sheet.

If the determination result is negative in step S31-3, that is, if the time t is equal to or shorter than the predetermined time T, the processing goes to step S32 and the foregoing oblique conveyance correction operation is performed. Thereafter, in step S34 to step S37, the same operation as in step S25 to step S28 in the flat path printing is performed and the normal printing operation is terminated. In other words, in the course of step S29 to step S37, the sheet guide flapper M3030 is constantly located in the position as shown in FIG. 18A without any rotation.

Herein, any one of or both of foregoing steps S31-1 and S31-3 can be omitted.

As has been described above, according to this embodiment, the flat path printing can be performed by use of a sheet fed from the sheet feeding section. Thus, a conveyance load is prevented from varying, thereby not leading to deterioration in print quality. Moreover, since the apparatus itself performs the entire operation from feeding to discharging a stacked printing medium, the apparatus can eliminate the necessity for a user to do troublesome work by himself/herself for setting a printing medium on the flat path, and also eliminate the possibility that oblique conveyance or the like occurs. Furthermore, since printing media are fed from the sheet feeding section, the flat path printing can be performed continuously on multiple sheets.

3.3 Another Embodiment of Flat-Path Section

Figure 19:
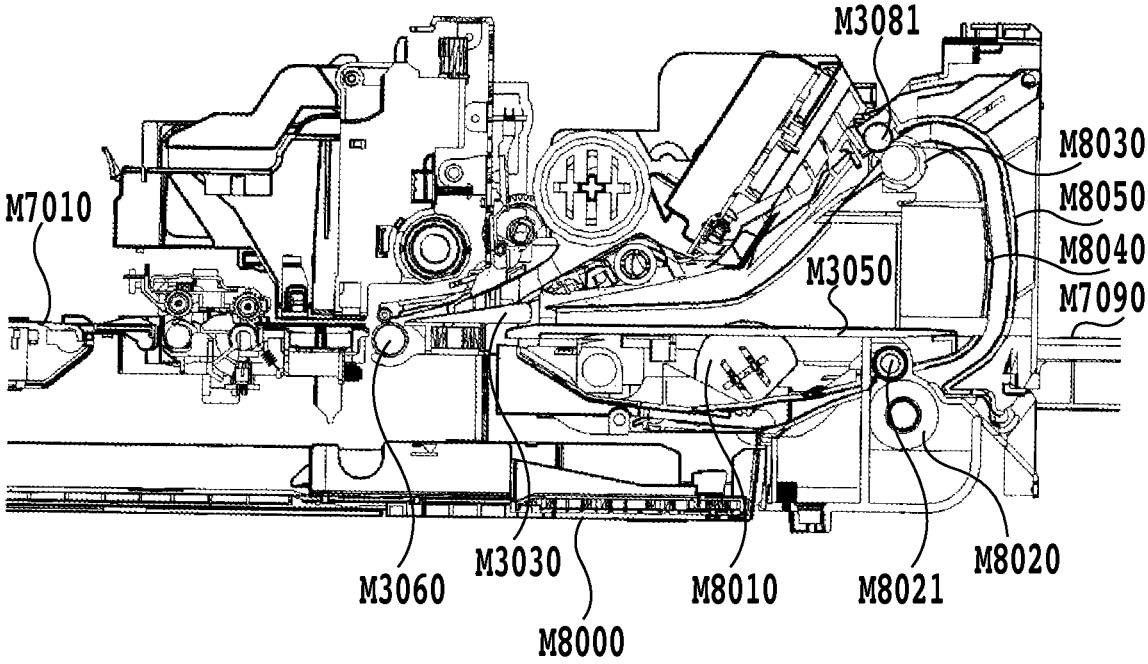
FIG. 19 is a cross sectional view of a printing apparatus showing another embodiment of the flat path section.
Figure 20A:
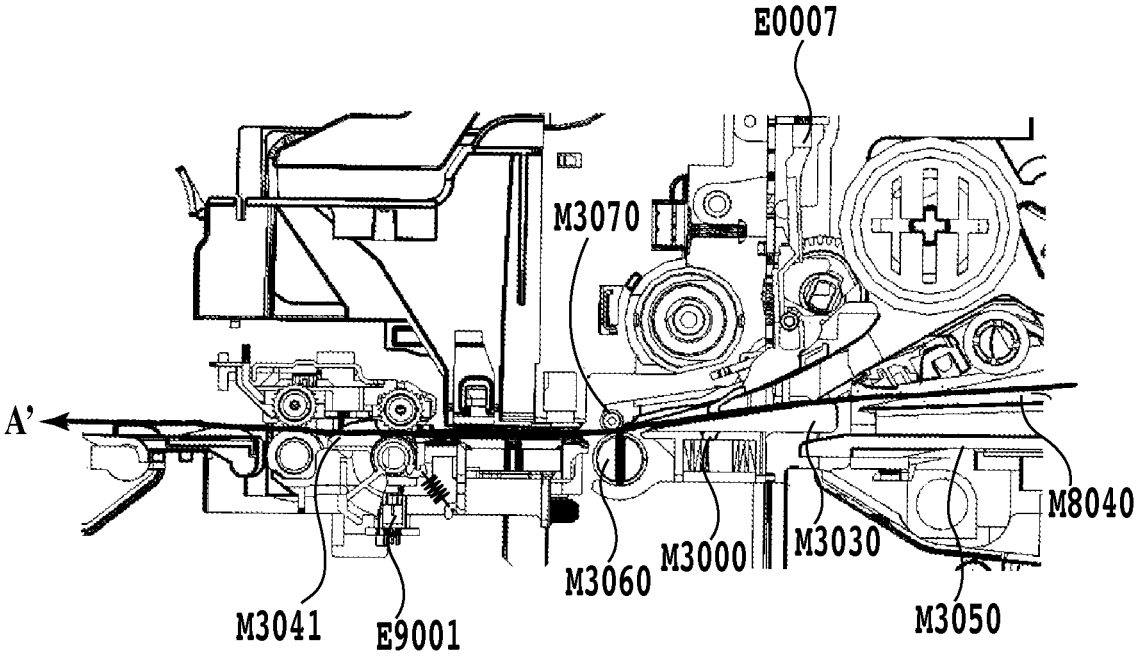
FIGS. 20A and 20B are cross sectional views of a main part of the printing apparatus for explaining flat path printing in the configuration shown in FIG. 19.
Figure 20B:
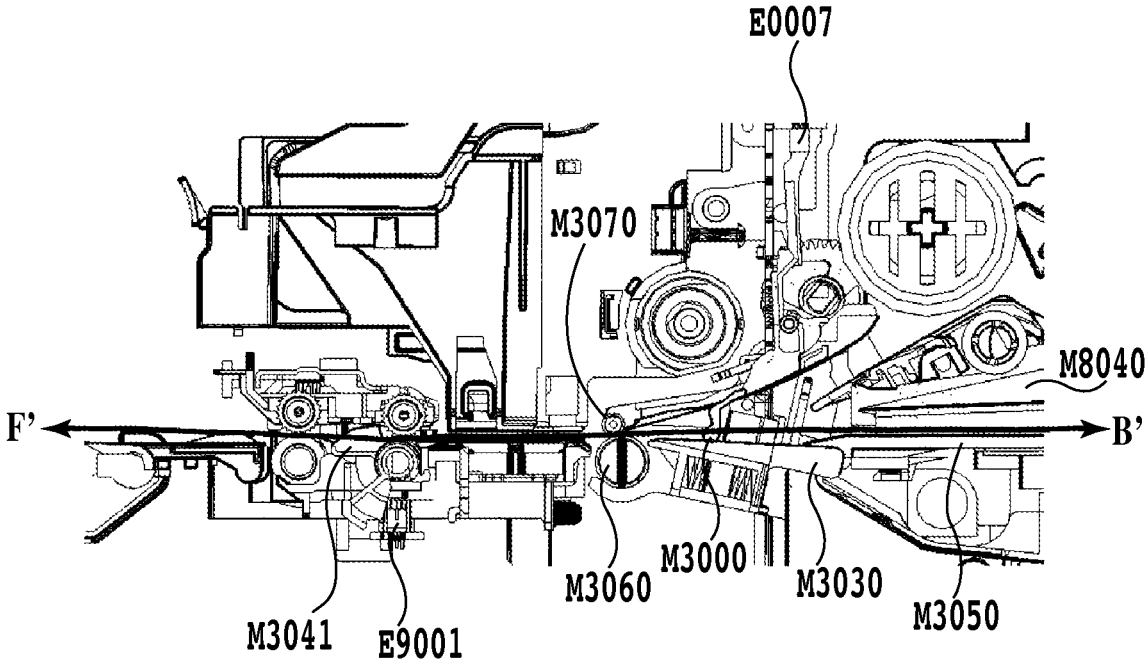

FIG. 19 is a cross sectional view of a printing apparatus showing another embodiment of the flat-path section. FIGS. 20A and 20B are cross sectional views of a main part of the printing apparatus for explaining flat path printing in the configuration shown in FIG. 19.

The foregoing embodiment is basically suitable for a configuration in which a printing medium stacked on the inclined sheet feeding tray is fed by the sheet feeding roller and is conveyed along the sheet feeding roller while curving gently. In contrast, this embodiment is suitable for a configuration in which a printing medium housed in a cassette disposed in a lower part of the apparatus is fed by a sheet feeding roller and is conveyed in the reverse direction after being bent largely in a U-shape and being turned over by the sheet feeding roller, a turn-over roller or other similar rollers. Such a path will be referred as a U-turn path.

In FIG. 19, a plurality of unillustrated printing media stacked in a cassette M8000 are separately fed by a pickup roller M8010, and are each guided to a nip portion between a first U-turn roller M8020 and a first driven roller M8021. Then, while being guided by a U-turn inner guide M8040 and a Upturn outer guide M8050, the printing medium is nipped and conveyed between a second U-turn roller M8030 and a second driven roller M3081 and then is conveyed to the sheet guide flapper M3030 being already on standby in the sheet feeding position after rotation.

The printing medium conveyance path after that is equivalent to that described with reference to FIGS. 17, 18A and 18B. More specifically, after sheet feeding starts, the printing medium is firstly conveyed from the U-turn inner guide M8040 to the sheet guide flapper M3030 as shown by an arrow A' in FIG. 20A. Then, when the rear end of the printing medium is conveyed to just before the nip portion between the conveying roller M3060 and the pinch rollers M3070 after passing by the PE sensor lever M3000, the sheet guide flapper M3030 is rotated to a position shown in FIG. 20B. The printing medium is reversely conveyed along an arrow B' in FIG. 20. At this time, since the sheet guide flapper M3030 is located in the flat path position, the printing medium is conveyed on the flat path guide M3050 disposed below the U-turn inner guide M8040.

A sequence in this embodiment is equivalent to that explained with reference to FIG. 16, and is different from that only in the conveyance path in the sheet feeding operation in step S10 and step S30. Accordingly, this embodiment can produce the same effects as the foregoing embodiment.

4. Others

In the aforementioned embodiments, the flat path printing is enabled by elevating the front cover M7010 and also by opening the rear tray M7090. However, as described above, the flat path printing can also be performed in a different manner, for example, when a printing medium has a length small enough to be accommodated inside the main body of the apparatus.

In addition, the descriptions have been provided for the embodiments in which the present invention is applied to the configuration having the gently curving conveyance path from the sheet feeding section, and the configuration having the largely curving U-turn path. Obviously, the present invention is also applicable to a printing apparatus including both the configurations.

In the aforementioned embodiments, the conveyance path (flat path) from the rear tray M7090 to the sheet delivery tray M3160 is made flat and horizontal. However, the term "flat" in this description of the invention does not necessarily mean flat in a strict sense. The conveyance path in the flat path state can be curving or concavo-convex to such an extent that a variation of the conveyance load does not deteriorates the print quality, although it depends on a type of printing medium to be used. In addition, this is also applicable to the term "horizontal". Thus, the conveyance path can be inclined from the horizontal plane to some extent.

Additionally, in the foregoing embodiments, whether or not to perform the flat path printing is determined depending on the printing quality and/or the type of printing medium set on a printer driver running in the computer-type host apparatus J0012. However, a user may designate whether or not to perform the flat path printing. Moreover, instead of the printer driver, the printer apparatus itself may be configured to be settable for designating whether or not to perform the flat path printing.

Moreover, it is apparent that the aforementioned number of tones (colors and densities) of inks and the aforementioned kinds of inks have been described only as examples.

Furthermore, although the foregoing embodiments have been described in connection with the printing method using the inkjet printing head that ejects ink as droplets, the printing method to which the present invention is applicable to produce the effects is not limited to this type of printing method. The present invention is applicable to any type of printing method if the method uses a printing head including an array of multiple printing elements such as nozzles or other types.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-155246, filed Jun. 13, 2008, which is hereby incorporated by reference herein in its entirety.

What is claimed is:

1. A printing apparatus comprising:

a feeder for feeding a printing medium;

a conveyance path configured to convey a printing medium through a print position where the printing medium is printed by a printing unit;

a control unit for controlling the printing apparatus selectively in a first mode and a second mode;

a discharge port for discharging the printing medium printed by the printing unit;

a tray located below the discharge port such that the printing medium discharged from the discharge port are stacked on the tray in the second mode, wherein the tray is configured to be lifted up to an upper position; and a detecting unit configured to detect that the tray is located at the upper position, wherein in the first mode, the control unit controls the printing apparatus such that a printing medium fed from the feeder is firstly conveyed up to a position where a rear end of the printing medium gets out of the feeder, after the first conveyance, the printing medium is conveyed reversely in the conveyance path, and that, after the reverse conveyance, the printing medium is conveyed to the print position and then the printing medium is printed by the printing unit, wherein in the second mode, the control unit controls the printing apparatus such that a printing medium fed from the feeder is printed by the printing unit without being conveyed reversely, wherein in the first mode, the tray supports a portion of the printing medium out from the apparatus body while printing medium is conveyed in the conveyance path such that the portion of the printing medium supported by the tray and a portion of the printing medium in the conveyance path are kept flat when the tray is located at the upper position, and wherein the controller controls the printing apparatus so as not to perform printing in the first mode when the detecting unit does not detect that the tray is located at the upper position.

2. A printing apparatus as claimed in claim 1, wherein the feeder is disposed above the conveyance path.

3. A printing apparatus as claimed in claim 1, further comprising a feeding path having a U-shape, wherein a printing medium fed from feeder is guided to the conveyance path by the feeding path.

4. A printing apparatus as claimed in claim 1, wherein one of the printing modes is selected depending on at least one of a type of the printing medium and a print quality.

5. A printing apparatus as claimed in claim 1, wherein the printing medium already printed by the printing unit is held horizontal, so that a conveyance load on the printing medium is prevented from varying while the printing unit is performing printing.

6. A printing apparatus as claimed in claim 1, wherein, when the printing medium fed from the feeder reaches the conveyance path , the position of the printing medium is corrected to prevent the printing medium from being conveyed obliquely.

7. A printing apparatus comprising:

a conveyance path on which a printing medium is conveyable;

a printing unit that performs printing on a printing medium conveyed on the conveyance path;

a feeder that separates stacked printing medium from one to another, and feeds each separated printing medium to the conveyance path; and a control unit for controlling the printing apparatus selectively in a first mode and a second mode;

a discharge port for discharging the printing medium printed by the printing unit; and a tray for supporting the printing medium discharged from the discharge port, wherein in the first mode the control unit controls the printing apparatus such that a printing medium fed from the feeder is conveyed until a rear end of the printing medium gets out of the feeder and then is reversely conveyed, and then in which printing is started, wherein in the second mode the control unit controls the printing apparatus such that printing is started under a condition where a part of a printing medium fed from the feeder still remains on the feeder, wherein the tray is configured to be lifted up for supporting a portion of the printing medium out from the apparatus body while printing medium is conveyed in the conveyance path such that the portion of the printing medium supported by the tray and a portion of the printing medium in the conveyance path are kept flat, and wherein controller controls the printing apparatus so as not to perform printing in the first mode when a detecting unit does not detect that the tray is lifted up.

8. A printing apparatus as claimed in claim 7, wherein the control unit selects the mode based on print information transmitted from a host apparatus.

9. A printing apparatus as claimed in claim 7, further comprising a sensor that detects a type of printing medium, and wherein the control unit selects the mode based on a detection signal transmitted from the sensor.

10. A printing apparatus as claimed in claim 7, further comprising a determination unit that determines a conveyance time required to convey a printing medium for a predetermined part of the conveyance path, and wherein the control unit selects the mode based on the conveyance time determined by the determination unit.

* * * * *